US011837148B2

(12) United States Patent
Pyun et al.

(10) Patent No.: US 11,837,148 B2
(45) **Date of Patent: *Dec. 5, 2023**

(54) DISPLAY DEVICE IN WHICH POWER SUPPLY VOLTAGE IS ADJUSTED BASED ON LENGTH OF IMAGE PATTERN

(71) Applicant: Samsung Display Co., Ltd., Yongin-Si (KR)

(72) Inventors: Ki Hyun Pyun, Yongin-si (KR); Won Jin Seo, Yongin-si (KR); Eun Jin Choi, Yongin-si (KR)

(73) Assignee: Samsung Display Co., Ltd., Yongin-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/877,594

(22) Filed: Jul. 29, 2022

(65) Prior Publication Data

US 2022/0366831 A1 Nov. 17, 2022

Related U.S. Application Data

(63) Continuation of application No. 17/024,608, filed on Sep. 17, 2020, now Pat. No. 11,403,989.

(30) Foreign Application Priority Data

Feb. 21, 2020 (KR) ..... 10-2020-0021856

(51) Int. Cl.
*G09G 3/20* (2006.01)

(52) U.S. Cl.
CPC ... *G09G 3/2092* (2013.01); *G09G 2300/0452* (2013.01); *G09G 2310/027* (2013.01); *G09G 2330/021* (2013.01); *G09G 2330/028* (2013.01)

(58) Field of Classification Search
CPC .. G09G 3/2003; G09G 3/2007; G09G 3/2092; G09G 5/10; G09G 2300/0421;
(Continued)

(56) References Cited

U.S. PATENT DOCUMENTS 9,691,323 B2 6/2017 Lee et al.
9,734,764 B2 8/2017 Park et al.
(Continued)

FOREIGN PATENT DOCUMENTS

KR 10-0590271 B1 6/2006
KR 10-1142637 B1 5/2012
(Continued)

*Primary Examiner* — Nathan Danielsen
(74) *Attorney, Agent, or Firm* — Innovation Counsel LLP

(57) ABSTRACT

A display device includes a plurality of pixels grouped into blocks divided into block rows extending in a first direction and arranged in a second direction, wherein each block includes two or more pixels connected to a first power source line, and each pixel is assigned with a grayscale value in a range of grayscale values that is divided into a plurality of grayscale sections; and a first power source voltage adjuster selecting a reference block row, and determining a magnitude of a first power source voltage supplied to the first power source line based on a number of blocks in the reference block row having a grayscale section that is same as a maximum grayscale section of the reference block row. The maximum grayscale section corresponds to a grayscale section that includes a largest grayscale value having a grayscale value ratio greater than a minimum ratio.

18 Claims, 34 Drawing Sheets

(58) Field of Classification Search
CPC ... G09G 2300/0426; G09G 2300/0452; G09G 2300/0804; G09G 2310/027; G09G 2310/06; G09G 2320/0223; G09G 2320/0233; G09G 2320/0242; G09G 2320/0252; G09G 2320/04; G09G 2330/021; G09G 2330/023; G09G 2330/025; G09G 2330/028
See application file for complete search history.

(56) References Cited

U.S. PATENT DOCUMENTS

| | | | | |
|---|---|---|---|---|
| 10,297,184 | B2 | 5/2019 | Jeong et al. | |
| 10,475,393 | B2 | 11/2019 | Lee et al. | |
| 2008/0170014 | A1* | 7/2008 | Jung | G09G 3/3233 345/82 |
| 2011/0273109 | A1 | 11/2011 | Park | |
| 2014/0240305 | A1 | 8/2014 | Chae et al. | |
| 2014/0285535 | A1 | 9/2014 | Pyo | |
| 2016/0086542 | A1* | 3/2016 | Lee | G09G 3/3225 345/212 |
| 2016/0293101 | A1 | 10/2016 | Jeong et al. | |
| 2017/0116902 | A1 | 4/2017 | Kuo et al. | |

FOREIGN PATENT DOCUMENTS

| | | | |
|---|---|---|---|
| KR | 10-1327841 | B1 | 11/2013 |
| KR | 10-2016-0100428 | A | 8/2016 |
| KR | 10-2016-0119913 | A | 10/2016 |
| KR | 10-2018-0062048 | A | 6/2018 |
| KR | 10-1883925 | B1 | 8/2018 |
| KR | 10-2023927 | B1 | 9/2019 |

* cited by examiner

DISPLAY DEVICE IN WHICH POWER SUPPLY VOLTAGE IS ADJUSTED BASED ON LENGTH OF IMAGE PATTERN

CROSS-REFERENCE TO RELATED APPLICATION

This application is a Continuation of U.S. application Ser. No. 17/024,608 filed on Sep. 17, 2020 (now U.S. Pat. No. 11,403,989), which claims priority to and benefit of Korean Patent Application No. 10-2020-0021856 filed in the Korean Intellectual Property Office on Feb. 21, 2020, under 35 U.S.C. § 119. The above applications are incorporated herein by reference.

BACKGROUND

1. Technical Field

The present disclosure relates to a display device and a method of driving the same.

2. Discussion of the Related Art

With the development of information technology, display devices have become increasingly important as a connection medium between users and information. According to this trend, the use of various types of display devices such as a liquid crystal display device, an organic light emitting display device, a plasma display device, and the like has been increasing.

A display device may include a plurality of pixels and display an image by optically combining light emitted from the pixels. A user views and recognizes the image that is continuously displayed in a plurality of image frames.

When an image frame is divided into a plurality of blocks, even if the total load of the image frame is the same, and the maximum grayscale values of the blocks are the same, an amount of a power source voltage required may vary depending on the number of blocks having a maximum grayscale. Therefore, supplying the same power source voltage for all image frames may be inefficient in terms of power consumption.

SUMMARY

A display device and a method of driving the same according to an embodiment of the present disclosure reduces power consumption by supplying a minimum power source voltage according to the number of blocks having a maximum grayscale calculated by analyzing the maximum grayscale and a load of each of a plurality of blocks in an image frame.

According to one embodiment, a display device may include: a plurality of pixels grouped into a plurality of blocks, wherein the plurality of blocks is divided into a plurality of block rows extending in a first direction and arranged in a second direction, each of the plurality of block includes two or more pixels connected to a first power source line, and each of the plurality of pixels is assigned with a grayscale value in a range of grayscale values that is divided into a plurality of grayscale sections; and a first power source voltage adjuster selecting a reference block row among the plurality of block rows, and determining a magnitude of a first power source voltage supplied to the first power source line based on a number of blocks in the reference block row having a grayscale section that is same as a maximum grayscale section of the reference block row.

The maximum grayscale section may correspond to a grayscale section that includes a largest grayscale value among the plurality of grayscale sections having a grayscale value ratio greater than a minimum ratio.

The first power source voltage adjuster may determine that the magnitude of the first power source voltage is increased as the number of blocks having the maximum grayscale section among the blocks in the reference block row decreases, and determine that the magnitude of the first power source voltage is decreased as the number of blocks having the maximum grayscale section among the blocks in the reference block row increases.

The first power source voltage adjuster may include: a maximum grayscale section and load value provider that provides the maximum grayscale section and a load value for each block among the plurality of blocks using the grayscale values of an image frame; a maximum grayscale block calculator that selects the reference block row among the plurality of block rows and calculates the number of blocks corresponding to the maximum grayscale section among the blocks in the reference block row; a first memory including first lookup tables; and a first switch selecting one of the first lookup tables in response to the number of blocks corresponding to the maximum grayscale section provided from the maximum grayscale block calculator.

The display device may further include a plurality of first power sources, each connected to at least one of first power source sub-lines, and the first power source sub-lines may be connected to the first power source line and are arranged in the first direction.

The maximum grayscale section and load value provider may include: a grayscale value counter receiving the grayscale values for each of the plurality of blocks and calculating grayscale value ratios of the plurality of grayscale sections; a maximum grayscale section detector receiving the grayscale value ratios and detecting the maximum grayscale section for each of the blocks in the plurality of block rows and a grayscale value ratio of the maximum grayscale section; and a load value calculator receiving the grayscale values for each of the plurality of blocks and calculating the load value for each block and a total load value of the image frame.

Each of the pixels may include a plurality of sub-pixels emitting light in different colors, and the load value calculator may calculate load values for the plurality of blocks by applying different weights to each of the grayscale values corresponding to the plurality of sub-pixels.

The maximum grayscale block calculator may include: a reference block row selector selecting the reference block row among the plurality of block rows based on the load values for each block; and a maximum grayscale block detector detecting the number of blocks having the maximum grayscale section in the reference block row based on the maximum grayscale section received from the maximum grayscale section detector and the grayscale value ratio of the maximum grayscale section.

The reference block row selector may select the reference block row based on a largest total sum of the load values for each block among the plurality of block rows.

The first memory may include the first lookup tables corresponding to the number of blocks having the maximum grayscale section.

The first power source voltage adjuster may select one of the first lookup tables based on the number of blocks having the maximum grayscale section in the reference block row through the first switch.

A selected first lookup table among the plurality of first lookup tables may provide the first power source voltage increased as the grayscale value ratio of the maximum grayscale section increases.

The display device may further include a second power source voltage adjuster selecting a reference block column among a plurality of block columns extending in the second direction and arranged in the first direction among the plurality of blocks, and determining the magnitude of the first power source voltage supplied to the first power source line based on the number of blocks in the reference block row having the grayscale section that is same as a maximum grayscale section of the reference block column among the plurality of blocks in the reference block column.

The maximum grayscale section and load value provider may include: a grayscale value counter receiving the grayscale values for each of the plurality of blocks and calculating the grayscale value ratios of the plurality of grayscale sections; a maximum grayscale section detector receiving the grayscale value ratios and detecting the maximum grayscale section for each of the blocks in the plurality of block columns and the grayscale value ratio of the maximum grayscale section; and a load value calculator receiving the grayscale values for each of the plurality of blocks and calculating the load value for each block and a total load value of the image frame.

The second power source voltage adjuster may determine that the magnitude of the first power source voltage is increased as the number of blocks having the maximum grayscale section among the blocks in the reference block column increases, and determine that the magnitude of the first power source voltage is decreased as the number of blocks having the maximum grayscale section among the blocks in the reference block column decreases.

The second power source voltage adjuster may include: a maximum grayscale section and load value provider that provides the maximum grayscale section and a load value for each block among the plurality of blocks using the grayscale values of the image frame; a maximum grayscale block calculator that selects the reference block column among the plurality of block columns and calculates the number of blocks corresponding to the maximum grayscale section among the blocks in the reference block column; a second memory including second lookup tables; and a second switch selecting one of the second lookup tables in response to the number of blocks corresponding to the maximum grayscale section provided from the maximum grayscale block calculator.

The maximum grayscale block calculator may include: a reference block column selector selecting the reference block column among the plurality of block columns based on the load values for each block; and a maximum grayscale block detector detecting the number of blocks having the maximum grayscale section in the reference block column based on the maximum grayscale section received from the maximum grayscale section detector and grayscale value ratio of the maximum grayscale section.

The reference block column selector may select the reference block column based on a largest total sum of the load values for each block among the plurality of block columns.

The second memory may include the second lookup tables corresponding to the number of blocks having the maximum grayscale section.

The second power source voltage adjuster may select one of the second lookup tables based on the number of blocks having the maximum grayscale section in the reference block column through the second switch.

A selected second lookup table among the second lookup tables may provide the first power source voltage increased as the grayscale value ratio of the maximum grayscale section increases.

BRIEF DESCRIPTION OF THE DRAWINGS

The accompanying drawings provide a further understanding of the inventive concepts, and are incorporated in and constitute a part of the present disclosure to illustrate exemplary embodiments of the inventive concepts, and, together with the detailed description, serve to explain principles of the inventive concepts.

DETAILED DESCRIPTION OF THE ILLUSTRATED EMBODIMENTS

Figure 1:
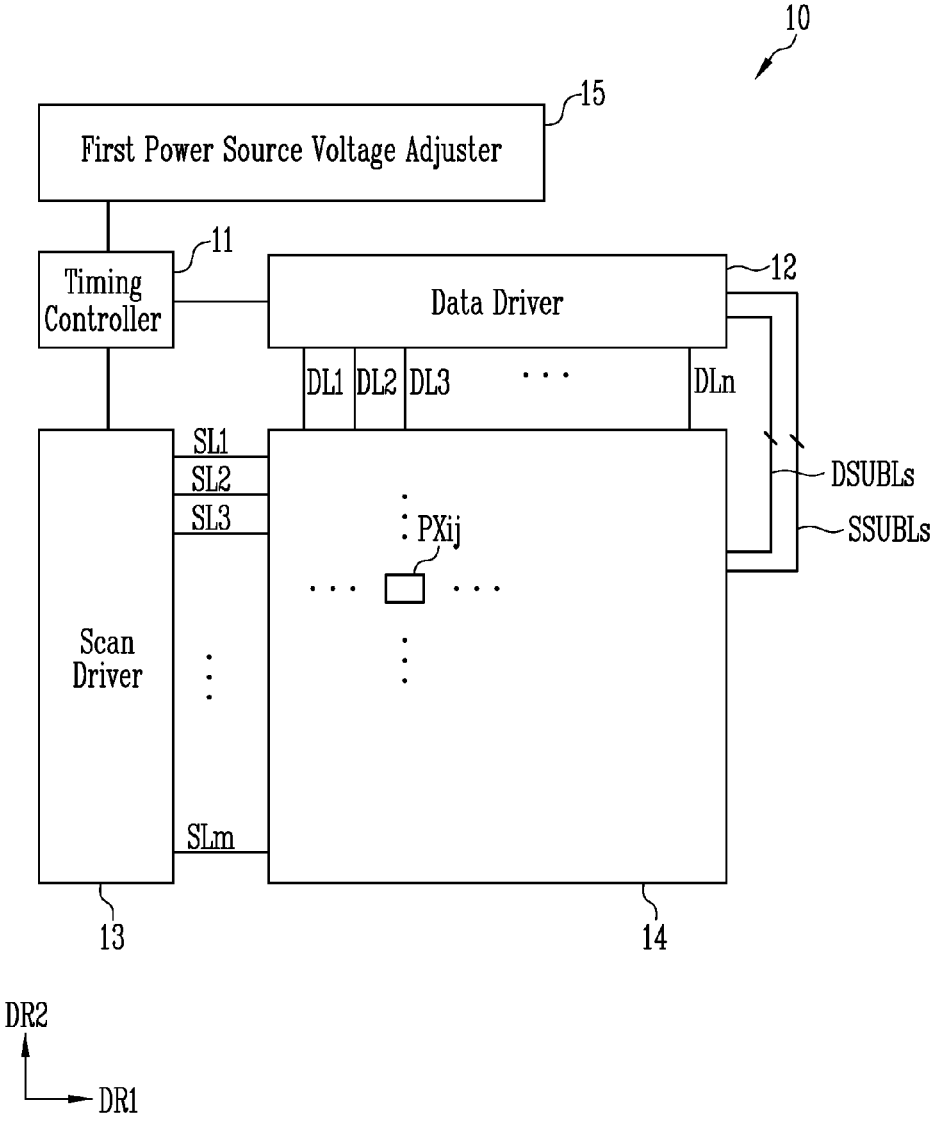
FIG. 1 is a block diagram of a display device according to an embodiment of the present disclosure.

Hereinafter, embodiments of the present disclosure will be described in detail with reference to the accompanying drawings so that those skilled in the art can easily understand and implement the present disclosure. The present disclosure may be embodied in various forms and is not limited to the embodiments described herein. The embodiments of the present disclosure may be used in combination with each other, or may be used independently of each other.

In order to clearly illustrate the present disclosure, components and parts that are not related to the description are omitted, and the same or similar components are denoted by the same reference numerals throughout the present disclosure. Therefore, some reference numerals can be used in multiple drawings.

In addition, the size and thickness of each component and part shown in the drawings are arbitrarily shown for convenience of explanation, and thus the present disclosure is not necessarily limited to those shown in the drawings. In the drawings, thicknesses may be exaggerated for clarity of presentation of layers and regions.

FIG. 1 is a block diagram of a display device according to an embodiment of the present disclosure.

Referring to FIG. 1, a display device 10 may include a timing controller 11, a data driver 12, a scan driver 13, a pixel unit 14, and a first power source voltage adjuster 15.

The timing controller 11 may receive grayscale values and control signals for each image frame from an external processor. The timing controller 11 may render the grayscale values suitable for specifications of the display device 10. For example, the external processor may provide a red grayscale value, a green grayscale value, and a blue grayscale value for each dot in the pixel unit 14. However, in a case where pixels in the pixel unit 14 has a pentile structure, the pixels may not correspond one to one to each grayscale value received from the external processor because adjacent dots share pixels, and rendering of the grayscale values is necessary. In contrast, in a case where the pixels correspond to each grayscale value on a one-to-one basis, rendering of the grayscale values by the timing controller 11 may be unnecessary. The timing controller 11 may provide rendered or non-rendered grayscale values to the data driver 12. In addition, the timing controller 11 may provide control signals suitable for specifications of the data driver 12 and the scan driver 13 to display the image frame.

The data driver 12 may generate data voltages and provide the data voltages to data lines DL1, DL2, DL3, . . . , and DLn (n being an integer greater than 1) based on the grayscale values and the control signals received from the timing controller 11. For example, the data driver 12 may sample the grayscale values using a clock signal and apply the data voltages corresponding to the grayscale values to the data lines DL1 to DLn for each pixel row. The data driver 12 may include one or more groups of driver units. According to the grouping of the driver units, the display device 10 may include a plurality of data drivers. An arrangement of the driver units will be described later with reference to the following drawings, for example, FIGS. 5 to 8.

The scan driver 13 may generate scan signals based on a clock signal, a scan start signal, and/or the like received from the timing controller 11 and provide the scan signals to scan lines SL1, SL2, SL3, . . . , and SLm (m being an integer greater than 1).

The scan driver 13 may sequentially supply the scan signals having a turn-on level pulse to the scan lines SL1 to SLm. The scan driver 13 may include a plurality of scan stages configured in the form of shift registers. The scan driver 13 may generate the scan signals by sequentially transmitting the scan start signal having a turn-on level pulse to a next scan stage under the control of the clock signal.

The pixel unit 14 may include a plurality of pixels. Each pixel PXij may be connected to a corresponding data line and a corresponding scan line, where i and j are integers greater than 1. The pixel PXij refers to a pixel in which a scan transistor (e.g., the scan transistor T2 in FIG. 2) is connected to an i-th scan line and a j-th data line.

The pixels may be commonly connected to a first power source line (not shown) and a second power source line (not shown). The pixel unit 14 may be divided into blocks. Each block may include two or more pixels commonly connected to the first power source line. The first power source line and the blocks will be described later.

The first power source line may be connected to first power source sub-lines DSUBLs. The first power source sub-lines DSUBLs may be connected to corresponding first power sources. In one embodiment, the data driver 12 may include the first power sources, and the first power source sub-lines DSUBLs may be connected to the data driver 12. In another embodiment, the data driver 12 and the first power sources may be configured separately. For example, the first power sources may be directly connected to a power management integrated chip (PMIC) (not shown) rather than the data driver 12. In this case, the first power source sub-lines DSUBLs may not be connected to the data driver 12.

The second power source line may be connected to second power source sub-lines SSUBLs. The second power source sub-lines SSUBLs may be connected to corresponding second power sources. In one embodiment, the data driver 12 may include the second power sources, and the second power source sub-lines SSUBLs may be connected to the data driver 12. In another embodiment, the data driver 12 and the second power sources may be configured separately. For example, the second power sources may be directly connected to a PMIC (not shown) rather than the data driver 12. In this case, the second power source sub-lines SSUBLs may not be connected to the data driver 12.

According to one embodiment, an image frame is divided into a plurality of blocks, and the first power source voltage adjuster 15 may determine a first power source voltage supplied to the first power source line based on the number of blocks having a maximum grayscale and a total load value of the image frame. For example, as the number of blocks having the maximum grayscale based on an X axis (for example, a first direction DR1) increases, the first power source voltage adjuster 15 may decrease the first power source voltage. Conversely, as the number of blocks having the maximum grayscale based on the X-axis (for example, the first direction DR1) decreases, the first power source voltage adjuster 15 may increase the first power source voltage. On the other hand, as the number of blocks having the maximum grayscale based on a Y-axis (for example, a second direction DR2) increases, the first power source voltage adjuster 15 may increase the first power source voltage. Conversely, as the number of blocks having the maximum grayscale based on the Y-axis (for example, the second direction DR2) decreases, the first power source voltage adjuster 15 may decrease the first power source voltage. The maximum grayscale and the load values for each block will be described later.

Figure 2:
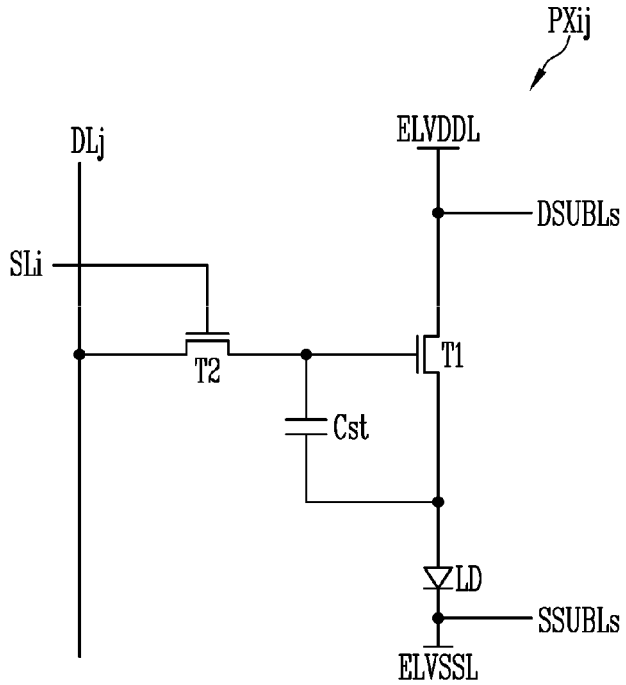
FIG. 2 is a circuit diagram of a pixel according to an embodiment of the present disclosure.

FIG. 2 is a circuit diagram of a pixel according to an embodiment of the present disclosure.

Referring to FIG. 2, the pixel PXij may include a first transistor T1, a second transistor T2, a storage capacitor Cst, and a light emitting diode LD.

Hereinafter, a circuit composed of N-type transistors will be described as an example of the first and second transistors T1 and T2. However, a person skilled in the art will be able to design a pixel circuit including P-type transistors by varying the polarities of voltages applied to gate terminals. Similarly, a person skilled in the art will be able to design a pixel circuit including a combination of a P-type transistor and an N-type transistor. The P-type transistor generally refers to a transistor in which the amount of current conducted increases when a voltage difference between a gate electrode and a source electrode increases in a negative direction. The N-type transistor generally refers to a transistor in which the amount of current conducted increases when a voltage difference between a gate electrode and a source electrode increases in a positive direction. The transistors T1 and T2 may be configured in various forms such as a thin film transistor (TFT), field effect transistor (FET), or bipolar junction transistor (BJT) without deviating from the scope of the present disclosure.

The first transistor T1 may include a gate electrode connected to a first electrode of the storage capacitor Cst, a first electrode connected to a first power source line ELVDDL, and a second electrode connected to a second electrode of the storage capacitor Cst. Herein, the first transistor T1 may be also referred to as a driving transistor.

The second transistor T2 may include a gate electrode connected to an i-th scan line SLi, a first electrode connected to a j-th data line DLj, and a second electrode connected to the gate electrode of the first transistor T1. Herein, the second transistor T2 may be also referred to as a scan transistor.

The light emitting diode LD may include an anode connected to the second electrode of the first transistor T1 and a cathode connected to a second power source line ELVSSL. The light emitting diode LD may include an organic light emitting diode, an inorganic light emitting diode, a quantum dot light emitting diode, or the like.

The first power source voltage may be applied to the first power source line ELVDDL, and the second power source voltage may be applied to the second power source line ELVSSL. For example, the first power source voltage may be greater than the second power source voltage.

When a scan signal of a turn-on level (e.g., high level) is applied through the scan line SLi, the second transistor T2 may be turned on. At this time, a data voltage applied to the data line DLj may be transmitted to the first electrode of the storage capacitor Cst, and the storage capacitor Cst may be charged based on the data voltage.

A positive driving current corresponding to a voltage difference between the first electrode and the second electrode of the storage capacitor Cst may flow between the first electrode and the second electrode of the first transistor T1. Accordingly, the light emitting diode LD may emit light at a luminance corresponding to the data voltage.

Next, when the scan signal of a turn-off level (here, low level) is applied through the scan line SLi, the second transistor T2 may be turned off, and the data line DLj and the first electrode of the storage capacitor Cst may be electrically separated. Therefore, even if the data voltage of the data line DLj changes, the voltage stored in the storage capacitor Cst does not change.

It is understood that the present embodiment of FIG. 2 can be applied to pixels of other circuits.

The first power source sub-lines DSUBLs may be commonly connected to the first power source line ELVDDL. That is, the first power source line ELVDDL and the first power source sub-lines DSUBLs may share their electrical nodes.

The second power source sub-lines SSUBLs may be commonly connected to the second power source line ELVSSL. That is, the second power source line ELVSSL and the second power source sub-lines SSUBLs may share their electrical nodes.

According to one embodiment, the first transistor T1 may be driven in a saturation state. As a voltage applied to the gate electrode of the first transistor T1 increases, the amount of driving current may increase. That is, the first transistor T1 may be operated as a current source. The condition for driving the first transistor T1 in the saturation state may expressed by Equation 1 below.

$$Vds >= Vgs - Vth \quad \text{[Equation 1]}$$

Here, Vds is a voltage difference between the drain electrode (e.g., the second electrode) and the source electrode (e.g., the first electrode) of the first transistor T1, Vgs is a voltage difference between the gate electrode and the source electrode of the first transistor T1, and Vth is a threshold voltage of the first transistor T1.

The light emitting diode LD may emit light with luminance corresponding to the amount of driving current. Therefore, in order to display a high grayscale value, an increased gate voltage may be required than in a case of displaying a low grayscale value. In addition, according to Equation 1, an increased drain voltage corresponding to the increased gate voltage may be required. That is, in order to display the high grayscale value, an increased first power source voltage may be required compared to the case of displaying the low grayscale value.

By supplying a minimum first power source voltage for displaying an image frame (e.g., by satisfying Equation 1), power consumption of the display device 10 can be reduced.

Figure 3:
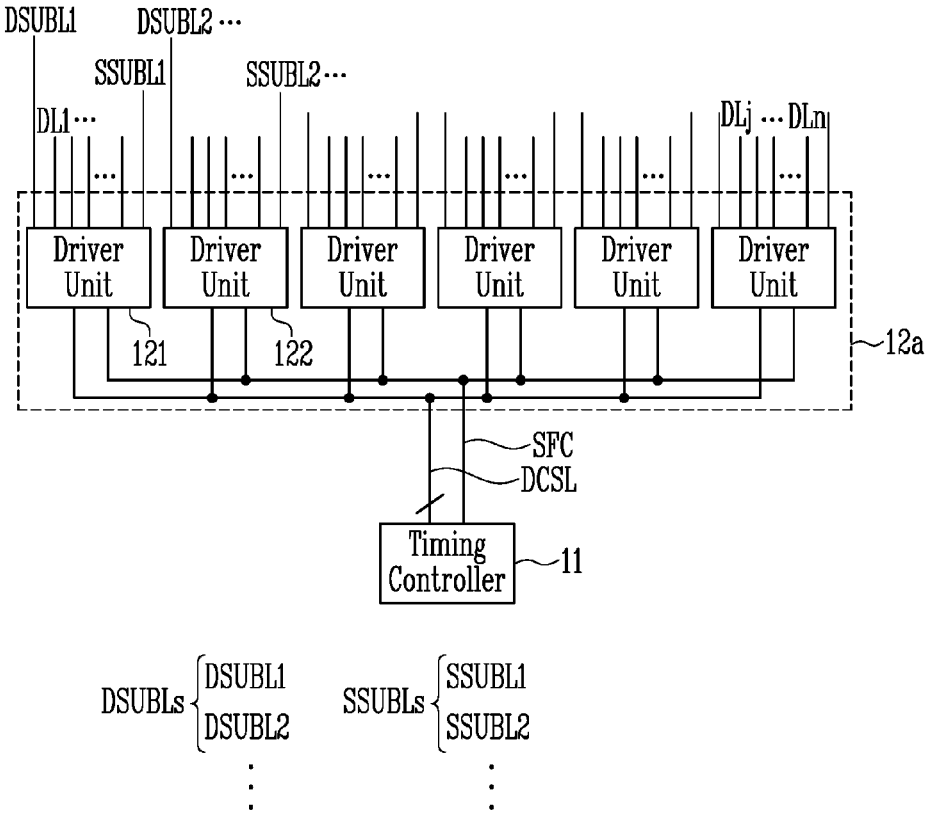
FIG. 3 is a block diagram of a data driver according to an embodiment of the present disclosure.

FIG. 3 is a block diagram of a data driver according to an embodiment of the present disclosure.

Referring to FIG. 3, a first data driver 12*a* may include a plurality of driver units including a first driver unit 121 and a second driver unit 122. The data lines DL1 to DLn may be grouped in one or more groups, and each group of the data lines may be connected to a respective driver unit.

The first and second driver units 121 and 122 may use a clock training line SFC as a common bus line. For example, the timing controller 11 may simultaneously transmit a notification signal for supplying a clock training pattern to all of the first and second driver units 121 and 122 through the clock training line SFC.

Each of the first and second driver units 121 and 122 may be connected to the timing controller 11 through a dedicated clock data line DCSL. For example, in a case where the display device 10 includes the plurality of first and second driver units 121 and 122, each of the first and second driver units 121 and 122 may be connected to the timing controller 11 through the corresponding clock data line DCSL.

According to one embodiment, one or more clock data lines DCSL may be connected to each of the first and second driver units 121 and 122. For example, in a case where it is difficult to achieve a desired bandwidth of a transmission signal using only one clock data line DCSL, a plurality of clock data lines DCSL may be connected to each driver unit to compensate for the difficulty of achieving the desired bandwidth. In addition, in a case where the clock data line DCSL is configured as a differential signal line, for example, to remove common mode noise, each driver unit may require a plurality of clock data lines DCSL.

Each of the first and second driver units 121 and 122 may include a first power source and a second power source. Among the first power sources, each first power source may be connected to at least one of the first power source sub-lines DSUBLs. Among the second power sources, each second power source may be connected to at least one of the second power source sub-lines SSUBLs. Each first power source may supply the first power source voltage through the corresponding first power source sub-line DSUBL. Each second power source may supply the second power source voltage through the corresponding second power source sub-line SSUBL.

For example, the first driver unit 121 may supply the first power source voltage to the first power source line ELVDDL through a first power source sub-line DSUBL1, and the first driver unit 121 may supply the second power source voltage to the second power source line ELVSSL through a second power source sub-line SSUBL1. Similarly, the second driver unit 122 may supply the first power source voltage to the first power source line ELVDDL through a first power source sub-line DSUBL2, and the second driver unit 122 may supply the second power source voltage to the second power source line ELVSSL through a second power source sub-line SSUBL2.

Figure 4:
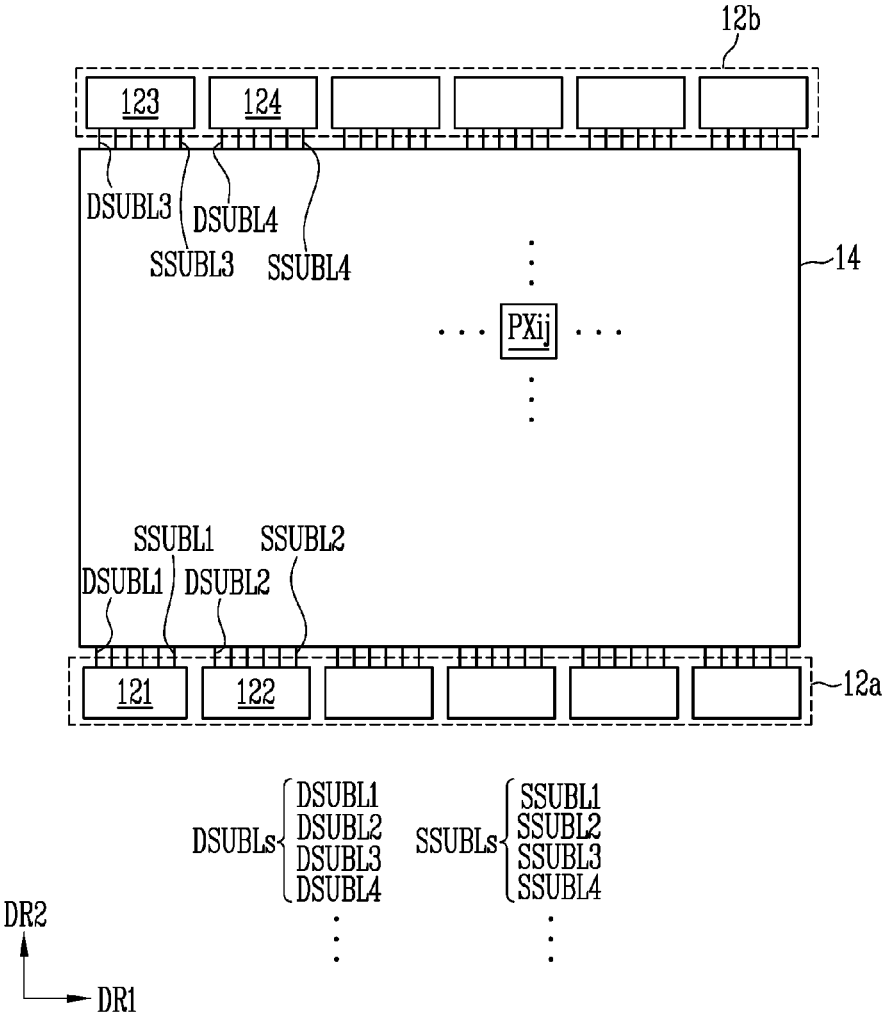
FIG. 4 illustrates an arrangement of a pixel unit and a data driver according to an embodiment of the present disclosure.

FIG. 4 illustrates an arrangement of a pixel unit and a data driver according to an embodiment of the present disclosure.

Referring to FIG. 4, the data driver 12 includes a first data driver 12*a* and a second data driver 12*b*.

The pixel unit 14 may have a planar shape extending in the first direction DR1 and the second direction DR2 that is orthogonal to the first direction DR1. In the present embodiment, for convenience of description, a case where the pixel unit 14 having a rectangular shape will be described as an example. In another embodiment, the pixel unit 14 may have a circular, elliptical, rhombus shape, or the like. In addition, the pixel unit 14 may be curved, foldable, or rollable, and a portion of the pixel unit 14 may change from a planar shape.

The first data driver 12*a* may be located on one side of the pixel unit 14. The first data driver 12*a* may include a plurality of driver units including the first driver unit 121 and the second driver unit 122. The first and second driver units 121 and 122 may include first power source sub-lines DSUBL1 and DSUBL2 and second power source sub-lines SSUBL1 and SSUBL2 that respectively extend in the second direction DR2. The first power source sub-lines DSUBL1 and DSUBL2 may be arranged in the first direction DR1. The second power source sub-lines SSUBL1 and SSUBL2 may be arranged in the first direction DR1.

The second data driver 12*b* may be located in an opposite side of the pixel unit 14 in the second direction DR2. The second data driver 12*b* may include a plurality of driver units including a third driver unit 123 and a fourth driver unit 124. The third and fourth driver units 123 and 124 may include first power source sub-lines DSUBL3 and DSUBL4 and second power source sub-lines SSUBL3 and SSUBL4 that respectively extend in the second direction DR2. The first power source sub-lines DSUBL3 and DSUBL4 may be arranged in the first direction DR1. The second power source sub-lines SSUBL3 and SSUBL4 may be arranged in the first direction DR1.

FIGS. 5 to 8 illustrate exemplary patterns of image frames. FIG. 9 is a plot showing examples of minimum first power source voltages corresponding to the patterns of FIGS. 5 to 8.

Figure 5:
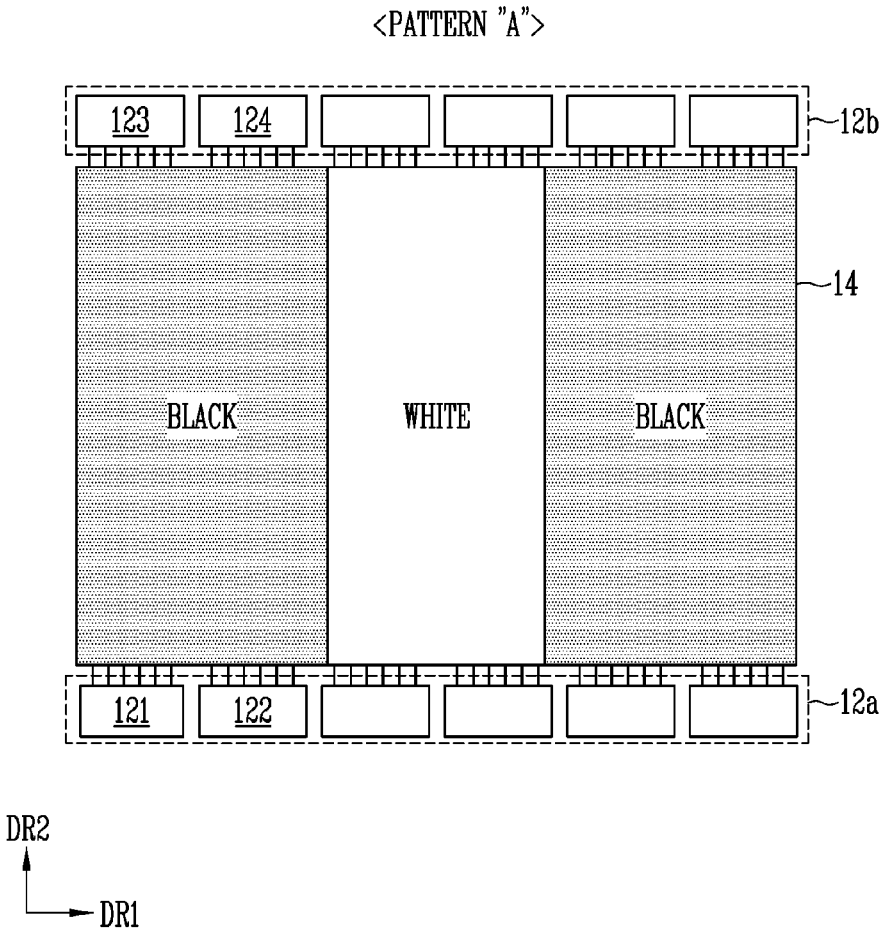
FIG. 5, FIG. 6, FIG. 7, and FIG. 8 illustrate exemplary patterns of image frames.

Referring to FIG. 5, an image frame having pattern "A" may be displayed on the pixel unit 14. In pattern "A", a black grayscale region, a white grayscale region, and another black grayscale region are alternately repeated in the first direction DR1, and there is no change in the grayscale pattern in the second direction DR2.

Figure 6:
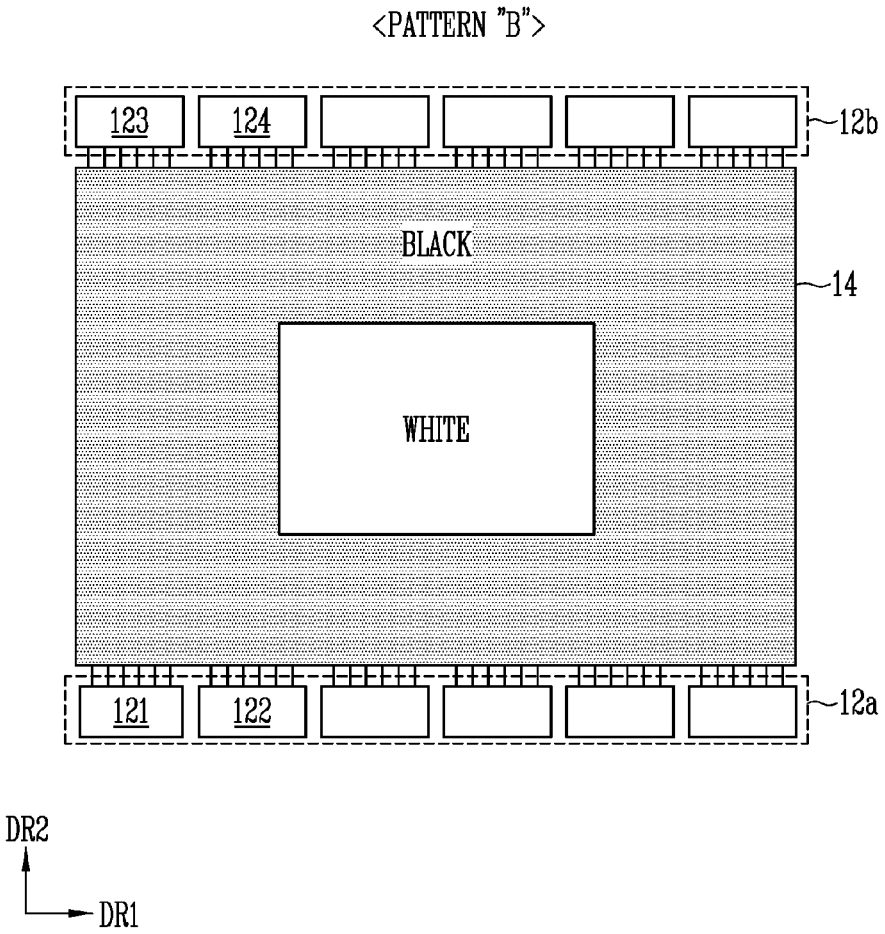

Referring to FIG. 6, an image frame having pattern "B" may be displayed on the pixel unit 14. In pattern "B", a black grayscale region, a white grayscale region, and another black grayscale region are alternately repeated in the first direction DR1 but only in a center region including the center of the pixel unit 14. Along the edges, there is black grayscale region extending in the first direction DR1. Similarly, the black-white-black pattern is only present in the second direction DR2 in the center region, and the edges extending in the second direction DR2 have black grayscale region. The number of pixels displaying the white grayscale in pattern "B" may be the same as the number of pixels displaying the white grayscale in pattern "A" (FIG. 6 is not drawn to scale).

Figure 7:
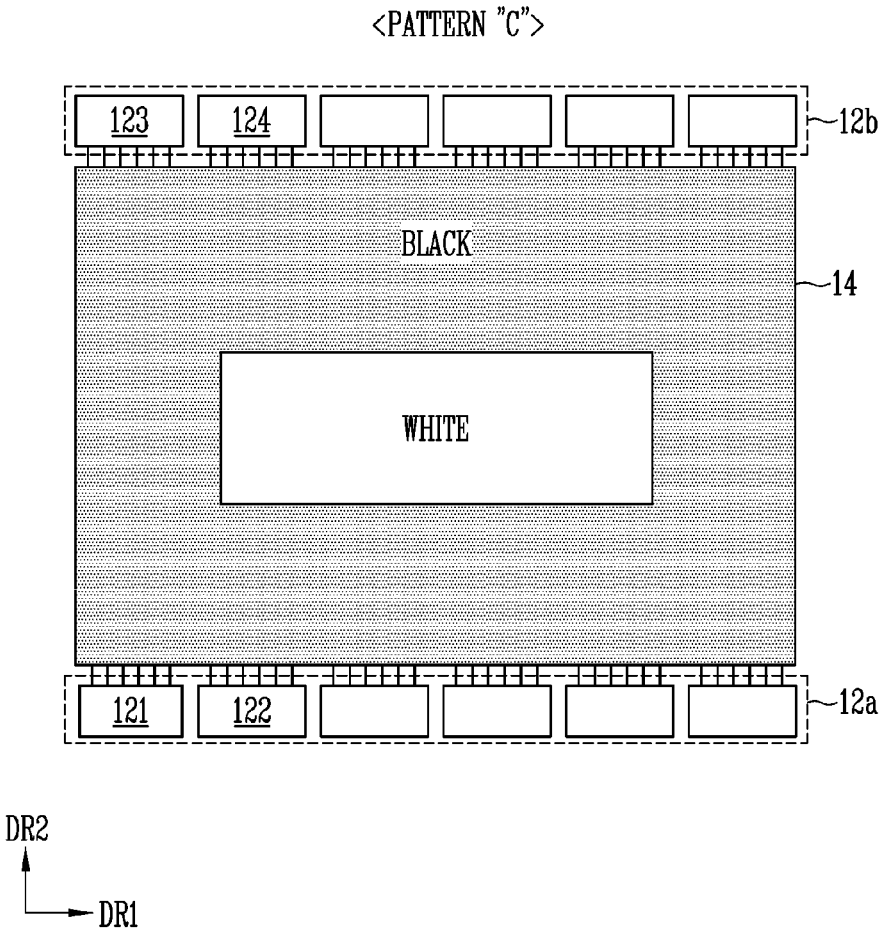

Referring to FIG. 7, an image frame having pattern "C" may be displayed on the pixel unit 14. In pattern "C", a black grayscale region, a white grayscale region, and another black grayscale region are alternately repeated in the first direction DR1 and the second direction DR2, only in the center region. Compared with pattern "B", a white grayscale region of pattern "C" may have a longer length in the first direction DR1 and a shorter length in the second direction DR2. The number of pixels displaying the white grayscale in pattern "C" may be the same as the number of pixels displaying the white grayscale in patterns "A" and "B" (figures are not drawn to scale).

Figure 8:
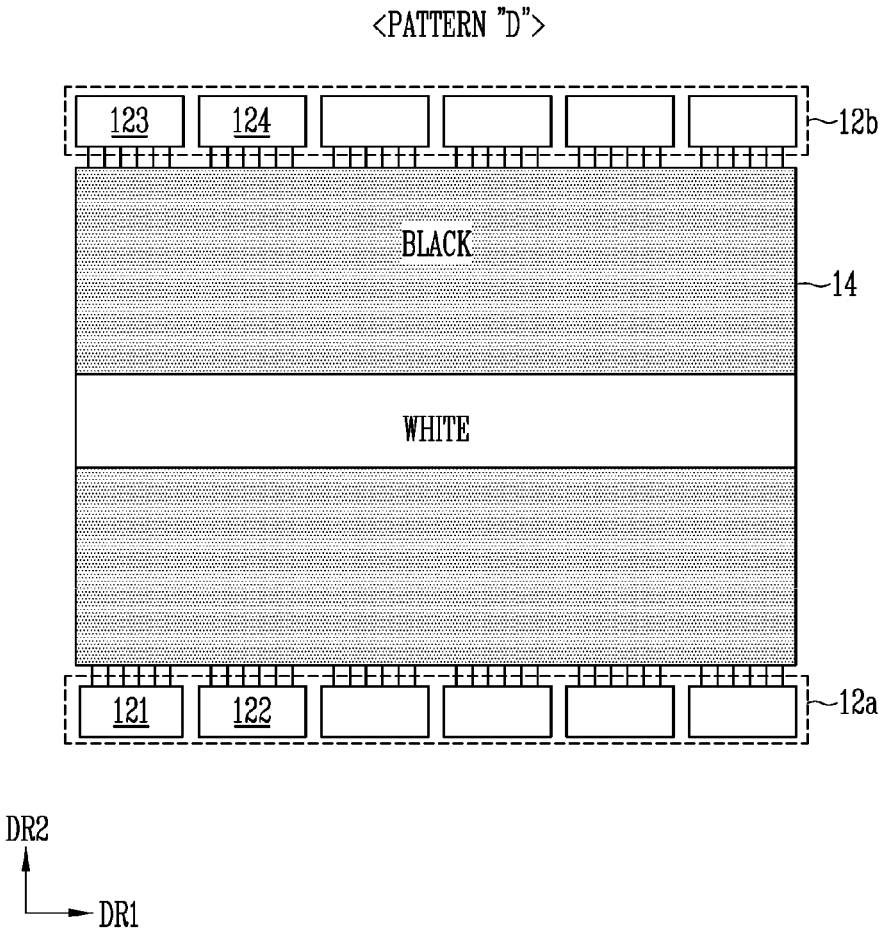
Figure 9:
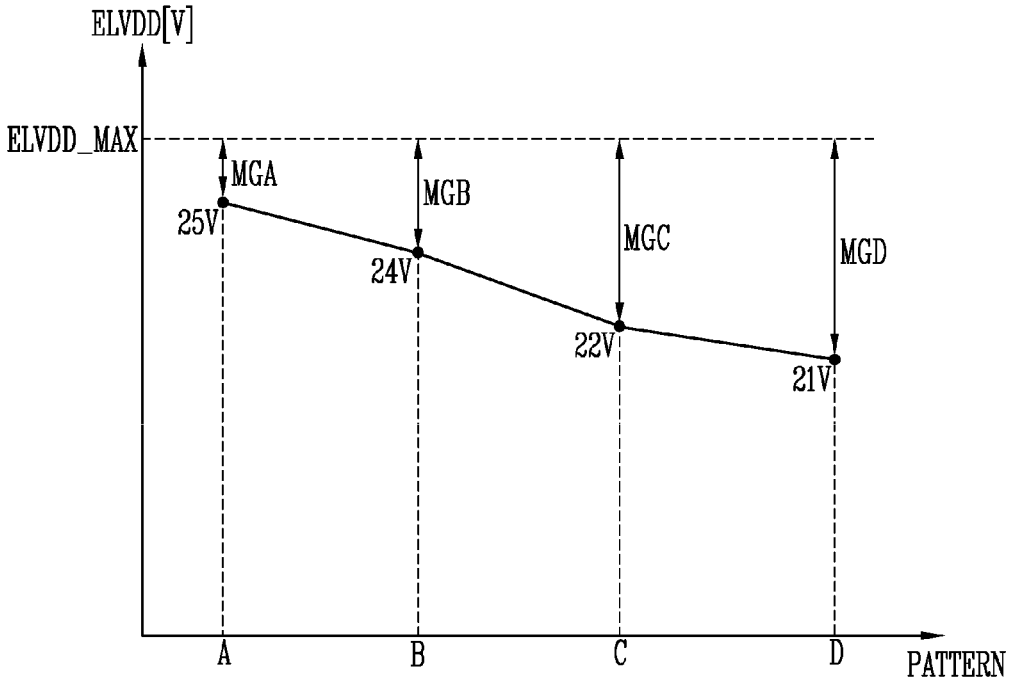
FIG. 9 is a plot showing examples of minimum first power source voltages corresponding to the patterns of FIGS. 5 to 8.

Referring to FIG. 8, an image frame having pattern "D" may be displayed on the pixel unit 14. In pattern "D", there is no change in the grayscale pattern in the first direction DR1, and a black grayscale region, a white grayscale region, and another black grayscale region are alternately repeated in the second direction DR2. The number of pixels displaying the white grayscale in pattern "D" may be the same as the number of pixels displaying the white grayscale in patterns "A", "B", and "C" (figures are not drawn to scale).

FIG. 9 shows that the minimum first power source voltage ELVDD required for displaying the image frame having different patterns shown in FIGS. 5 to 8 is reduced in the order of "A", "B", "C", and "D". For example, the first power source voltage ELVDD for displaying the image frame of pattern "A" may be 25V, the first power source voltage ELVDD for displaying the image frame of the "B" pattern may be 24V, the first power source voltage ELVDD for displaying the image frame of the "C" pattern may be 22V, and the first power source voltage ELVDD for displaying the image frame of the "D" pattern may be 21V.

As the number of the first, second, third, and fourth driver units 121, 122, 123, and 124 driven based on the order of "A", "B", "C", and "D" increases, resistance values of the first, second, third, and fourth driver units 121, 122, 123, and 124 facing each other may be reduced. As a result, the amount of an IR drop may be reduced.

Therefore, allowable margin values MGA, MGB, MGC, and MGD of the first power source voltage ELVDD may be increased in the order of "A", "B", "C", and "D" with respect to a maximum value ELVDD_MAX of the first power source voltage ELVDD. That is, the larger the margin value, the first power source voltage ELVDD having a lower voltage may be supplied.

Accordingly, a larger margin value can be achieved as the white grayscale region of the image frame is widely distributed in the first direction DR1, and, as a result, power consumption of the display device 10 may be reduced.

Referring to FIGS. 5 to 9, the display device 10 includes a total of twelve driver units including the first, second, third, and fourth driver units 121, 122, 123 and 124. However, the inventive concept of the present embodiment may be applied to the display device including at least two driver units without deviating from the scope of the present disclosure.

For example, first pixels may be commonly connected to the first power source line ELVDDL and may be connected to a first group of data lines. Second pixels may be commonly connected to the first power source line ELVDDL and may be connected to a second group of data lines. In this case, the data lines of the first group and the data lines of the second group may be different from each other.

The first driver unit 121 may be connected to the first power source line ELVDDL through a first power source sub-line DSUBL, and may be connected to the first group of data lines. The second driver unit 122 may be connected to the first power source line ELVDDL through a second power source sub-line SSUBL, and may be connected to the second group of data lines. Here, the term second power source sub-line SSUBL is defined to distinguish it from the first power source sub-line DSUBL, and does not necessarily mean that it is connected to the second power source line ELVSSL.

In a first pattern in which X pixels among the first pixels and Y pixels among the second pixels emit light (X and Y being integers greater than 1), and the remaining pixels among the first pixels and the remaining pixels among the second pixels do not emit light, a first voltage may be supplied to the first power source line ELVDDL. In addition, in a second pattern in which Z pixels among the first pixels emit light (Z being an integer greater than 1), and the remaining pixels among the first pixels and all the second pixels do not emit light, a second voltage may be supplied to the first power source line ELVDDL. In this case, the second voltage may be greater than the first voltage, where Z=X+Y is satisfied.

For example, the X pixels, the Y pixels, and the Z pixels may all emit light based on the same grayscale values. First luminance where the display device 10 displays the first pattern and second luminance where the display device 10 displays the second pattern may be the same.

For example, the first pattern may be pattern "D", and the second pattern may be one of patterns "A", "B", and "C". In another example, the first pattern is pattern "C", and the second pattern may be any of patterns "A" and "B". In yet another example, the first pattern is pattern "B", and the second pattern may be pattern "A".

Although the above-described embodiment is described based on the first power source line ELVDDL, other embodiments may be described based on the second power source line ELVSSL.

Figure 10:
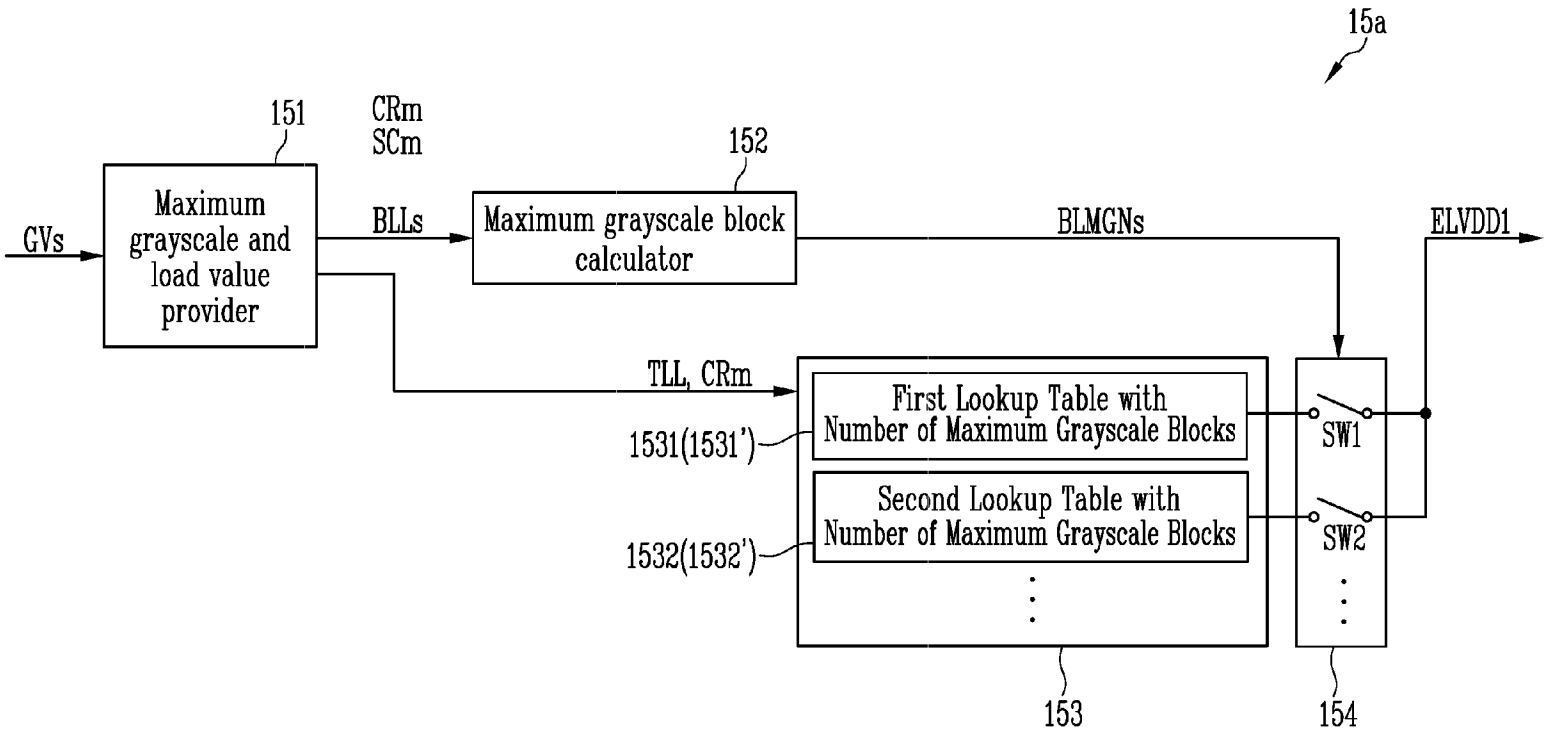
FIG. 10 is a block diagram of a first power source voltage adjuster according to an embodiment of the present disclosure.
Figure 11A:
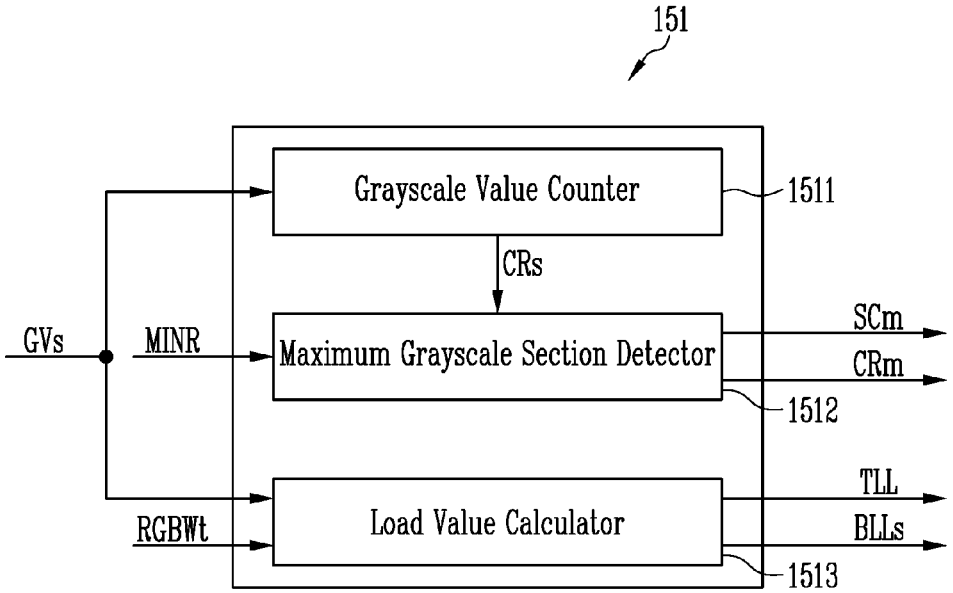
FIG. 11A is a block diagram of a maximum grayscale and load value provider according to an embodiment of the present disclosure.
Figure 11B:
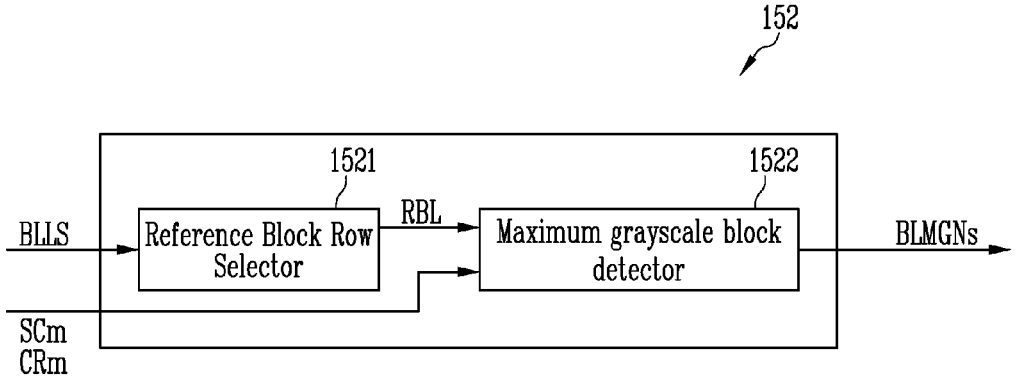
FIG. 11B is a block diagram of a provider of number of maximum grayscale blocks according to an embodiment of the present disclosure.
Figure 12A:
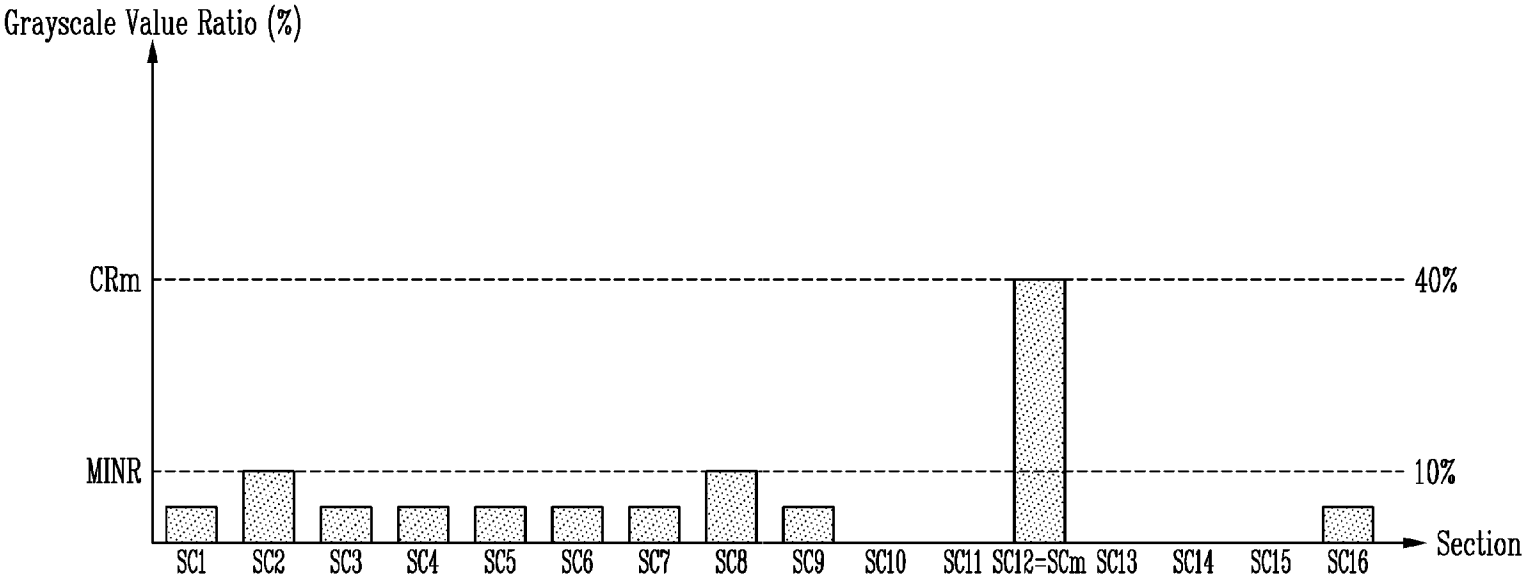
FIG. 12A, FIG. 12B, and FIG. 12C are plots showing examples of grayscale value ratios of a maximum grayscale detector according to an embodiment of the present disclosure.
Figure 12B:
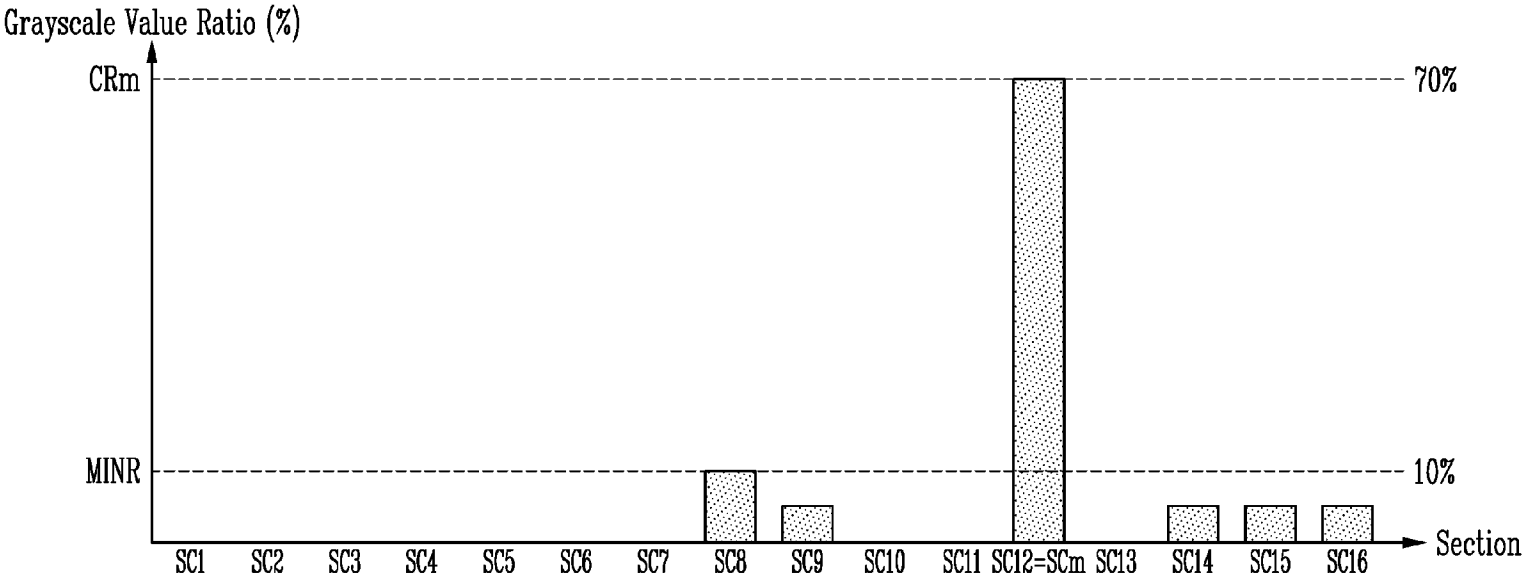
Figure 12C:
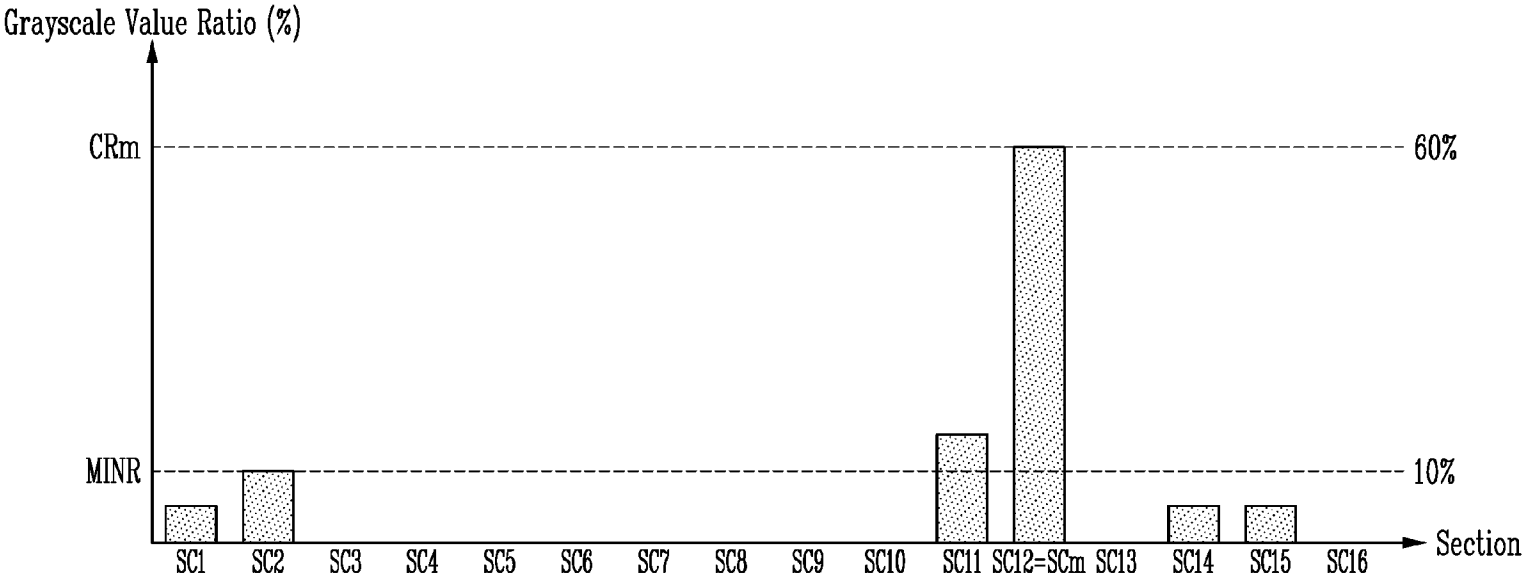
Figure 13:
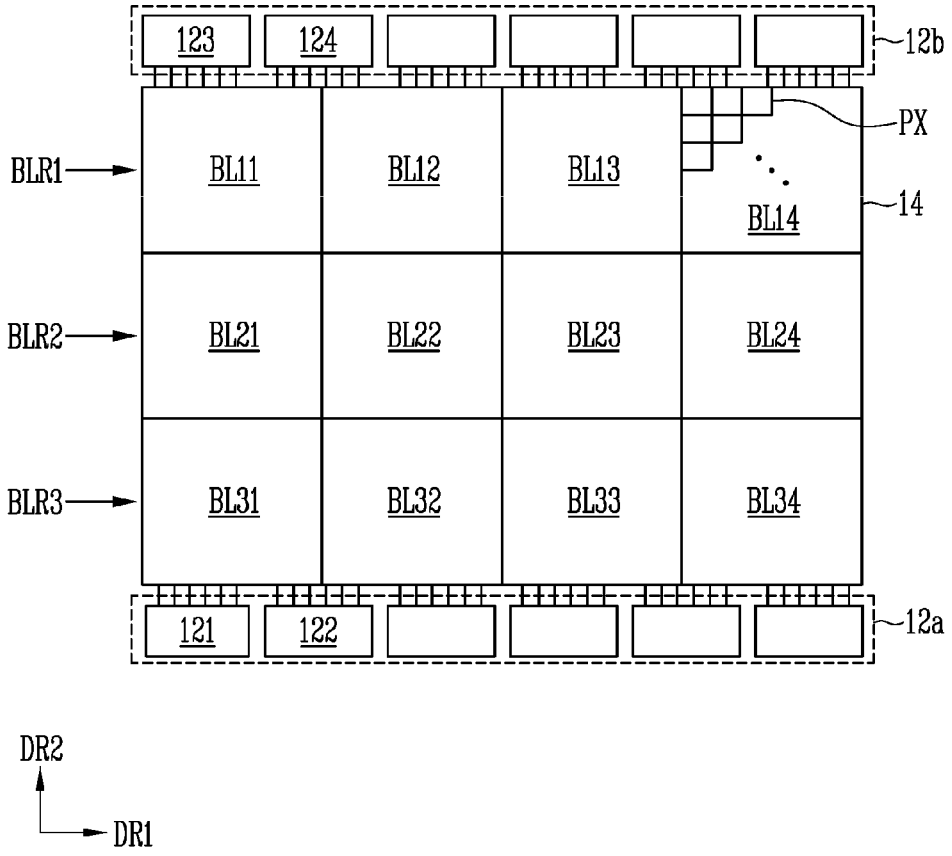
FIG. 13 illustrates an example of an image frame divided into a plurality of blocks according to an embodiment of the present disclosure.

FIG. 10 is a block diagram of a first power source voltage adjuster according to an embodiment of the present disclosure. FIG. 11A is a block diagram of a maximum grayscale and load value provider according to an embodiment of the present disclosure. FIG. 11B is a block diagram of a maximum grayscale block calculator according to an embodiment of the present disclosure. FIGS. 12A to 12C are plots showing examples of grayscale value ratios of a maximum grayscale detector according to an embodiment of the present disclosure. FIG. 13 illustrates an example of an image frame divided into a plurality of blocks according to an embodiment of the present disclosure. FIGS. 14 to 18B illustrate examples of lookup tables with a number of maximum grayscale blocks according to an embodiment of the present disclosure.

Referring to FIG. 10, a first power source voltage adjuster 15*a* may include a maximum grayscale and load value provider 151, a maximum grayscale block calculators 152, a first memory 153, and a first switch 154.

In an embodiment, as shown in FIG. 10, the first power source voltage adjuster 15*a* may be an IC chip that includes a plurality of blocks and/or circuit components partitioned in hardware. In another embodiment, the first power source voltage adjuster 15*a* may be an IC chip that includes the plurality of blocks and/or circuit components partitioned by software. In another embodiment, at least some of the blocks and/or circuit components of the first power source voltage adjuster 15*a* may be integrated with each other or further subdivided into hardware, software, or a combination of both. In another embodiment, the first power source voltage adjuster 15*a* may be integrated in the timing controller 11 as hardware, software, or a combination of both. In another embodiment, the first power source voltage adjuster 15*a* may be integrated in the data driver 12 as hardware, software, or a combination of both. As described above, the first power source voltage adjuster 15*a* may be configured in various forms within a range capable of achieving the inventive concepts of the present disclosure. The above description may be applied to other embodiments described later.

According to an embodiment of the present disclosure, the first power source voltage adjuster 15*a* may determine the first power source voltage ELVDD based on a number of blocks BLMGNs corresponding to a maximum grayscale section SCm in a specific block row that is selected from among a plurality of block rows extending in the first direction DR1 and arranged in the second direction DR2, and a load value of an image frame.

Referring to FIG. 13, the pixel unit 14 may be divided into 12 blocks arranged in a 3×4 matrix. In this case, the pixel unit 14 may include first to third block rows BLR1, BLR2, and BLR3. However, the number of the plurality of blocks and the number of rows and columns of the blocks in the image frame are not limited thereto, and may be variously changed according to the size of the image frame. Meanwhile, the load value of the image frame may be a total load value TLL of the image frame.

For example, in a case where the total load value TLL of the image frame is the same, as the number of blocks BLMGNs corresponding to the maximum grayscale section SCm in the specific block row among the first to third block rows BLR1, BLR2, and BLR3 decreases, the first power source voltage adjuster 15*a* may determine that the first power source voltage ELVDD is to be increased. Conversely, as the number of blocks BLMGNs corresponding to the maximum grayscale section SCm in the specific block row among the first to third block rows BLR1, BLR2, and BLR3 increases, the first power source voltage adjuster 15*a* may determine that the first power source voltage ELVDD is to be decreased.

Referring to FIG. 10 and FIG. 11A, the maximum grayscale and load value provider 151 may include a grayscale value counter 1511, a maximum grayscale section detector 1512, and a load value calculator 1513.

The grayscale value counter 1511 may receive grayscale values GVs for the image frame and calculate grayscale value ratios CRs of a plurality of sections divided according to the size of the grayscale values GVs for each block.

For example, in the embodiments of FIGS. 12A to 12C, the plurality of sections divided according to the size of the grayscale values GVs includes 16 sections.

In this example, the grayscale value counter 1511 may calculate the grayscale value ratios CRs of first to sixteenth sections SC1 to SC16 divided according to the size of the grayscale values GVs for each block BL11 to BL34.

Referring to FIGS. 12A to 12C, the first to sixteenth sections SC1 to SC16 may be set in advance according to the size of the grayscale values GVs. For convenience of description, it is assumed that each grayscale value GVs is represented by 8 bits and corresponds to one of 256 grayscale values. The 0 grayscale value may correspond to the black grayscale value (minimum grayscale value), and the 255 grayscale value may be the white grayscale value (maximum grayscale value). In another embodiment, each of the grayscale values GVs may be represented by various bits such as 10 bits and 12 bits.

For example, a first section SC1 may correspond to 0 to 14 grayscales, a second section SC2 may correspond to 15 to 30 grayscales, a third section SC3 may correspond to 31 to 46 grayscales, a fourth section SC4 may correspond to 47 to 62 grayscales, a fifth section SC5 may correspond to 63 to 78 grayscales, a sixth section SC6 may correspond to 79 to 94 grayscales, a seventh section SC7 may correspond to 95 to 110 grayscales, an eighth section SC8 may correspond to 111 to 126 grayscales, a ninth section SC9 may correspond to 127 to 142 grayscales, a tenth section SC10 may correspond to 143 to 158 grayscales, an eleventh section SC11 may correspond to 159 to 174 grayscales, a twelfth section SC12 may correspond to 175 to 190 grayscales, a thirteenth section SC13 may correspond to 191 to 206 grayscales, a fourteenth section SC14 may correspond to 207 to 222 grayscales, a fifteenth section SC15 may correspond to 223 to 238 grayscales, and a sixteenth section SC16 may correspond to 239 to 255 grayscales. In this embodiment, the first to sixteenth sections SC1 to SC16 are partitioned at equal intervals, but in other embodiments, the first to sixteenth sections SC1 to SC16 may be partitioned at different intervals.

The grayscale value counter 1511 may calculate the grayscale value ratios CRs of the grayscale values GVSs corresponding to each of the first to sixteenth sections SC1 to SC16 for each block BL11 to BL34.

For example, referring to FIGS. 12A and 13, in a case where a total number of red grayscale values in a block BL14 is 383*540, and the number of red grayscale values corresponding to the twelfth section SC12 is 383*216, a red grayscale value ratio CRs in the twelfth section SC12 may be 40%. In this case, a grayscale value ratio CRm in the maximum grayscale section SCm may be equal to 40%, i.e., the grayscale value ratio CRs in the twelfth section SC12 is 40%.

The maximum grayscale section detector 1512 may receive the red grayscale value ratios CRs for each block BL11 to BL34 from the reference block row selector 1511, and detect a maximum red grayscale section SCm among the sections having a grayscale value ratio CRm that is greater than a minimum ratio MINR (e.g., 10%). The maximum grayscale section detector 1512 may determine the twelfth section SC12 of the block BL14 as the maximum red grayscale section SCm.

In addition, referring to FIG. 12B, in a case where a total number of green grayscale values in the block BL14 is 383*540, and the number of green grayscale values corresponding to the twelfth section SC12 is 383*378, a green grayscale value ratio CRs in the twelfth section SC12 may be 70%. In this case, the grayscale value ratio CRm in the maximum grayscale section SCm may be equal to 70%, i.e., the grayscale value ratio CRs in the twelfth section SC12 is 70%.

The maximum grayscale section detector 1512 may receive the green grayscale value ratios CRs for each block BL11 to BL34 from the reference block row selector 1511, and detect a maximum green grayscale section SCm among the sections having a grayscale value ratio CRm that is greater than the minimum ratio MINR (e.g., 10%). The maximum grayscale section detector 1512 may determine the twelfth section SC12 of the block BL14 as the maximum green grayscale section SCm.

Similarly, referring to FIG. 12C, in a case where a total number of blue grayscale values in the block BL14 is 383*540, and the number of blue grayscale values corresponding to the twelfth section SC12 is 383*324, a blue grayscale value ratio CRs in the twelfth section SC12 may 60%. In this case, the grayscale value ratio CRm in the maximum grayscale section SCm may be equal to 60%, i.e., the grayscale value ratio CRs in the twelfth section SC12 is 60%.

The maximum grayscale section detector 1512 may receive the blue grayscale value ratios CRs for each block BL11 to BL34 from the reference block row selector 1511, and detect a maximum blue grayscale section SCm among the sections having a grayscale value ratio CRm that is greater than the minimum ratio MINR (e.g., 10%). The maximum grayscale section detector 1512 may determine the twelfth section SC12 of the block BL14 as the maximum blue grayscale section SCm.

The maximum grayscale section detector 1512 may obtain a total maximum grayscale section SCm based on the maximum red grayscale section SCm, the maximum green grayscale section SCm, and the maximum blue grayscale section SCm.

According to an embodiment of the present disclosure, in a case where the maximum red grayscale section SCm, the maximum green grayscale section SCm, and the maximum blue grayscale section SCm are the same, the total maximum grayscale section SCm may be the same. For example, in a case where the maximum red grayscale section SCm, the maximum green grayscale section SCm, and the maximum blue grayscale section SCm are the twelfth section SC12, the total maximum grayscale section SCm may be the twelfth section SC12.

According to another embodiment of the present disclosure, in a case where the maximum red grayscale section SCm, the maximum green grayscale section SCm, and the maximum blue grayscale section SCm are different, the total maximum grayscale section SCm of the block may be linearly calculated based on a ratio occupied by each of the red, green, and blue grayscale value ratios in a total sum of the grayscale value ratios CRs.

For example, in a case where the red grayscale value ratio CRs of the tenth section SC10, which is the maximum red grayscale section SCm of the block BL14, is 40%, the green grayscale value ratio CRs in the twelfth section SC12, which is the maximum green grayscale section SCm of the block BL14, is 70%, and the blue grayscale value ratio CRs in the fourteenth section SC14, which is the maximum blue grayscale section SCm of the block BL14, is 60%, the total maximum grayscale section SCm may be calculated by: 40/(40+70+60)*10+70/(40+70+60)*12+60/(40+70+60)*14=12.23, which corresponds to the twelfth section SC12.

The maximum grayscale section detector 1512 may provide the maximum grayscale section SCm and the grayscale value ratio CRm corresponding to the maximum grayscale section SCm to the maximum grayscale block calculator 152.

The load value calculator 1513 may receive the grayscale values GVs for the image frame from the maximum grayscale section detector 1512 and provide load values BLLs for each of the blocks BL11 to BL34 based on the grayscale values GVs. For example, the load value calculator 1513 may calculate a load value for the block BL14 by summing the grayscale values GVs corresponding to the pixels PX in the block BL14 (see FIG. 13).

The load value calculator 1513 may apply different weights RGBWt to the grayscale values GVs of different colors. For example, the load value calculator 1514 may multiply the red grayscale values by a weight RGBWt of 1.2, multiply the green grayscale values by a weight RGBWt of 0.8, and multiply the blue grayscale values by a weight RGBWt of 1.0, and may sum those values to calculate the load value. In another embodiment, the maximum grayscale and load value provider 151 may apply the same weight RGBWt to the grayscale values GVs of different colors.

In addition, the load value calculator 1513 may sum the load values BLLs for the blocks BL11 to BL34 to obtain an average value and calculate a total load value TTL of the image frame. The load value calculator 1513 may provide the total load value TLL of the image frame to the first memory 153.

Referring to FIG. 11B, the maximum grayscale block calculator 152 may receive the maximum grayscale section SCm, the grayscale value ratio CRm corresponding to the maximum grayscale section SCm, and the load values BLLs for each block from the maximum grayscale and load value provider 151 and calculate the number of maximum grayscale blocks BLMGNs. The maximum grayscale block calculator 152 may provide the calculated number of maximum grayscale blocks BLMGNs to the first switch 154.

According to an embodiment of the present disclosure, the maximum grayscale block calculator 152 may include a reference block row selector 1521 and a maximum grayscale block detector 1522.

The reference block row selector 1521 may select one reference block row RBL among the first to third block rows BLR1, BLR2, and BLR3 based the load values BLLs for each block.

For example, a block row having the largest total sum of load values BLLs of a plurality of blocks in the block row among the first to third block rows BLR1 to BLR3 may be selected as the reference block row RBL.

Figure 14:
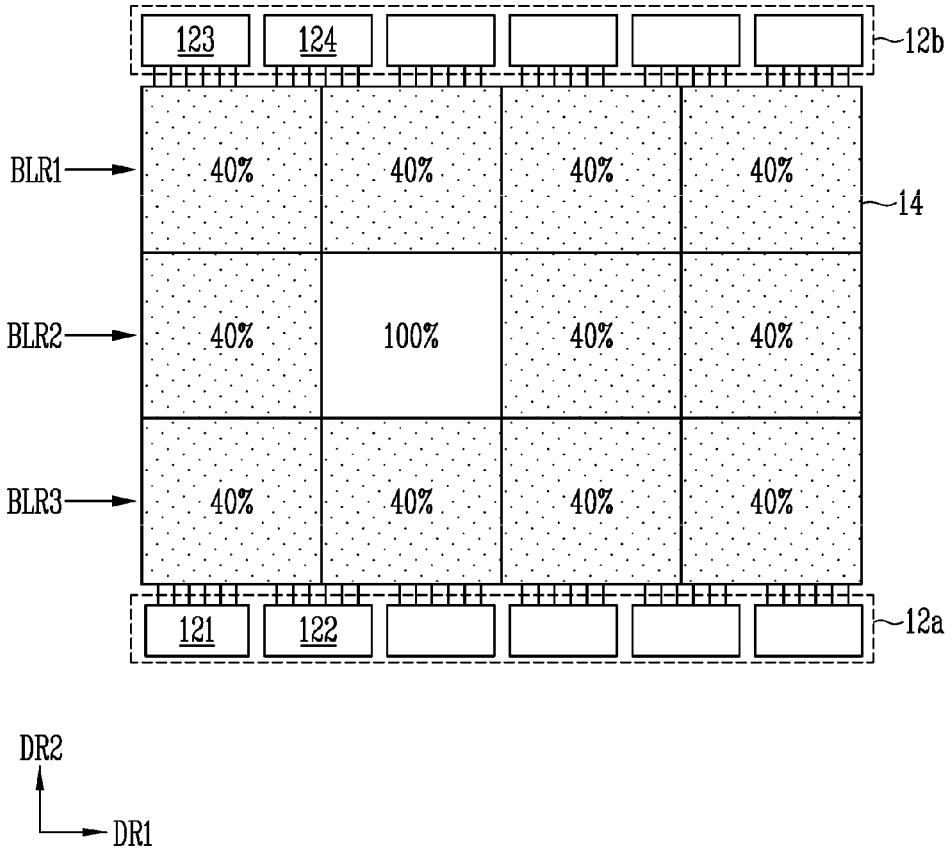
FIG. 14, FIG. 15, FIG. 16, FIG. 17, FIG. 18A, and FIG. 18B illustrate examples of lookup tables with a number of maximum grayscale blocks according to an embodiment of the present disclosure.
Figure 15:
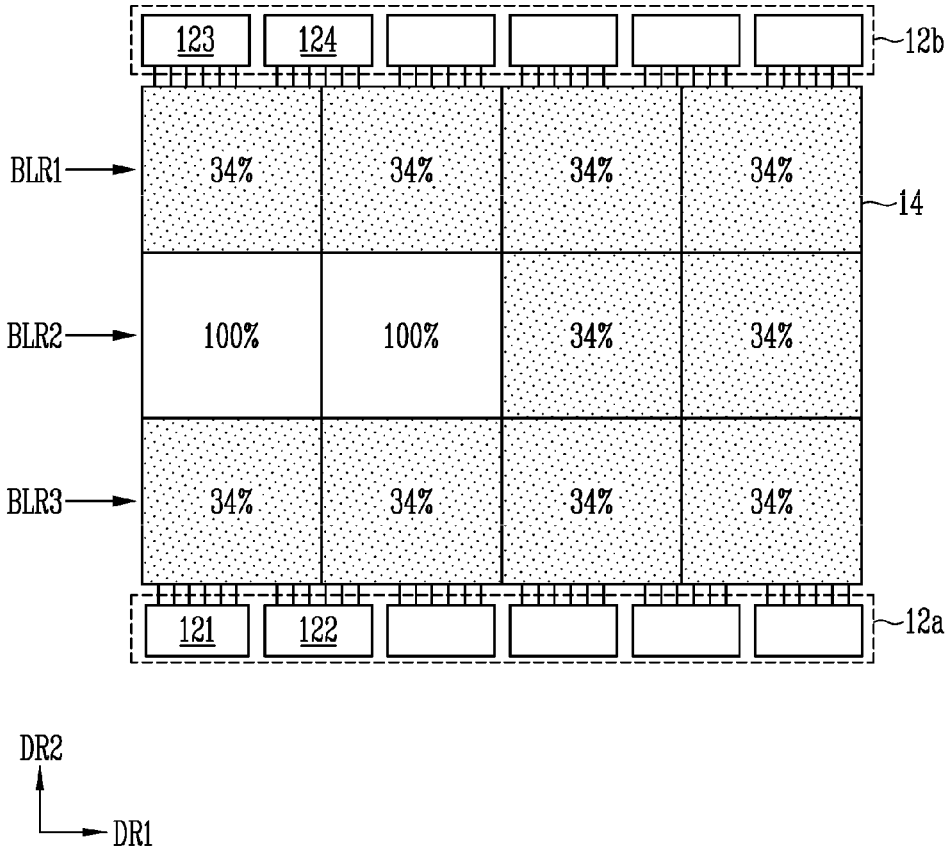
Figure 16:
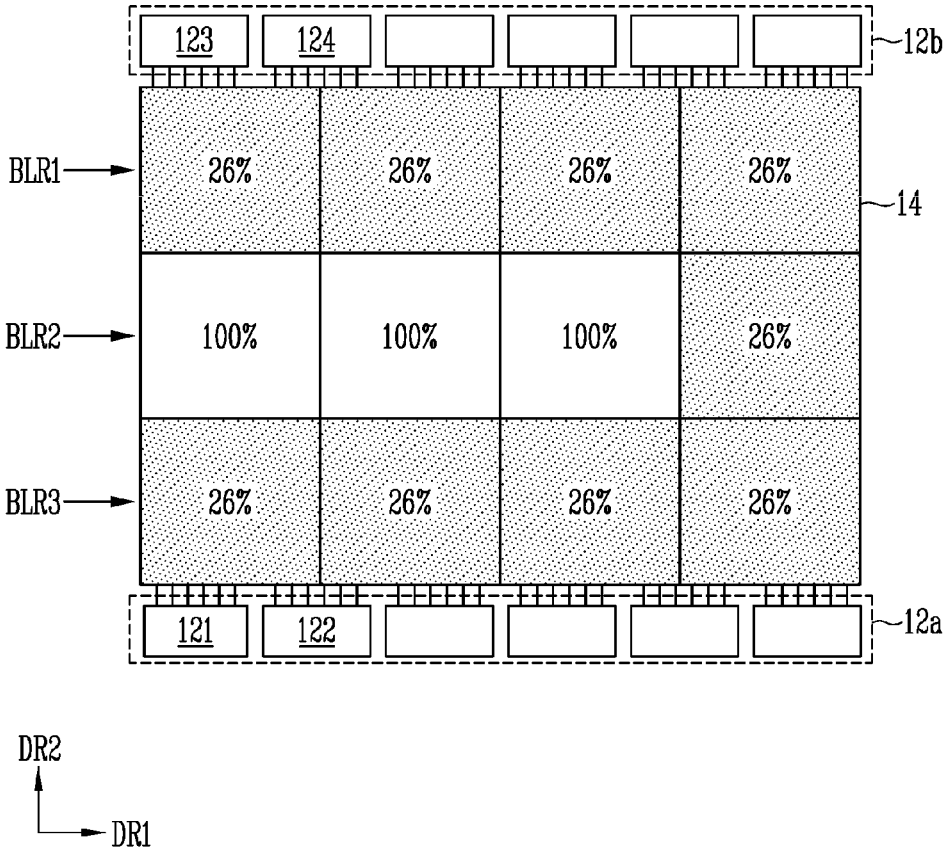

Referring to FIG. 14, first and third block rows BLR1 and BLR3 have a total sum of load values BLLs of 160%, and a second block row BLR2 has a total sum of load values BLLs of 220%. Therefore, the reference block row selector 1521 may select the second block row BLR2 as the reference block row RBL. Similarly, in a case of the embodiments of FIGS. 15 to 17, the reference block row selector 1521 may select the second block row BLR2 as the reference block row RBL.

The maximum grayscale block detector 1522 may receive the reference block row RBL from the reference block row selector 1521, and detect the number of maximum grayscale blocks BLMGNs defined as the number of blocks having the same maximum grayscale section as the maximum grayscale section of the reference block row among the blocks in the reference block row RBL using the maximum grayscale section SCm and the grayscale value ratio CRm corresponding to the maximum grayscale section SCm that are received from the maximum grayscale section detector 1512 of the maximum grayscale and load value provider 151. Here, the maximum grayscale section SCm of the reference block row RBL may refer to a grayscale section including the largest grayscale value among the grayscale sections having a grayscale value ratio that is greater than the minimum ratio MINR.

In the embodiments of FIGS. 14 to 17, the total load value TLL of the image frame is the same, for example, 45%, and the grayscale value ratio CRm in the maximum grayscale section SCm of the second block row BLR2 is the same at 100%, but the number of maximum grayscale blocks BLMGNs is different from each other. In this case, an amount of IR drop of each first power source voltage ELVDD1 may be the largest in FIG. 14 and the smallest in FIG. 17. Since the number of the first, second, third, and fourth driver units 121, 122, 123, and 124 driven in the order of FIG. 14, FIG. 15, FIG. 16, and FIG. 17 increases, the resistance values of the first, second, third, and fourth driver units 121, 122, 123, and 124 facing each other may be reduced. As a result, the amount of IR drop may be reduced.

Figure 17:
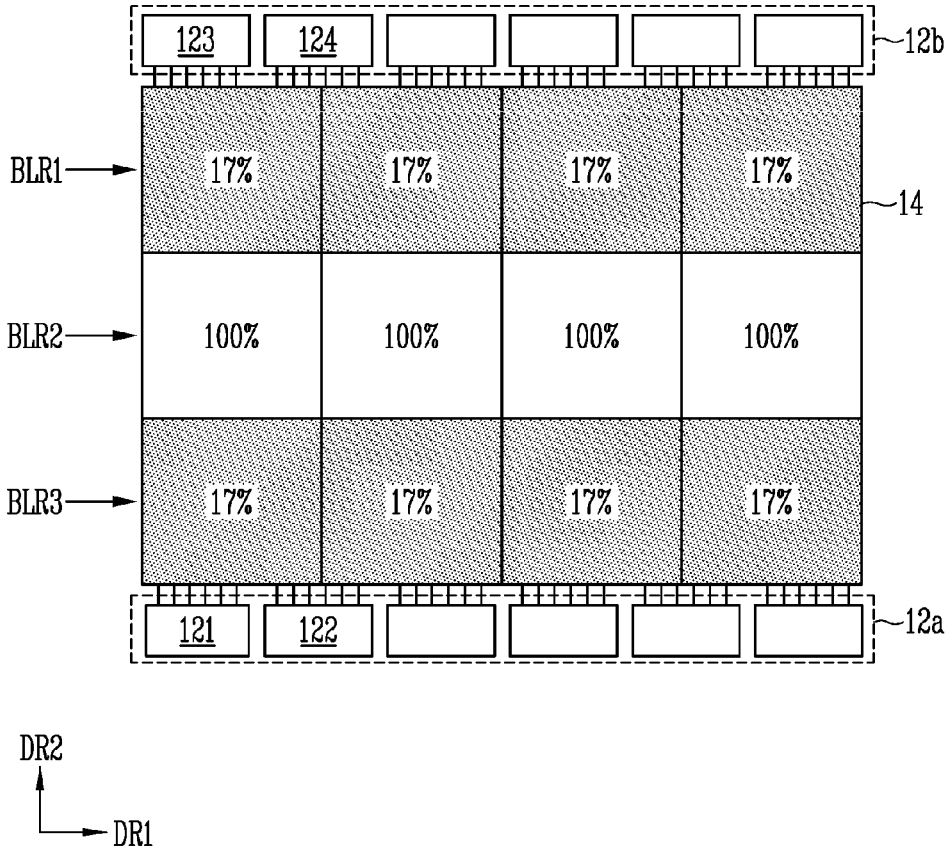

Accordingly, in a case where the same first power source voltage ELVDD1 is provided in the embodiments of FIGS. 14 to 17, an issue associated with luminance reduction may occur in the embodiment of FIG. 14 compared to the embodiment of FIG. 17.

Figure 18B:
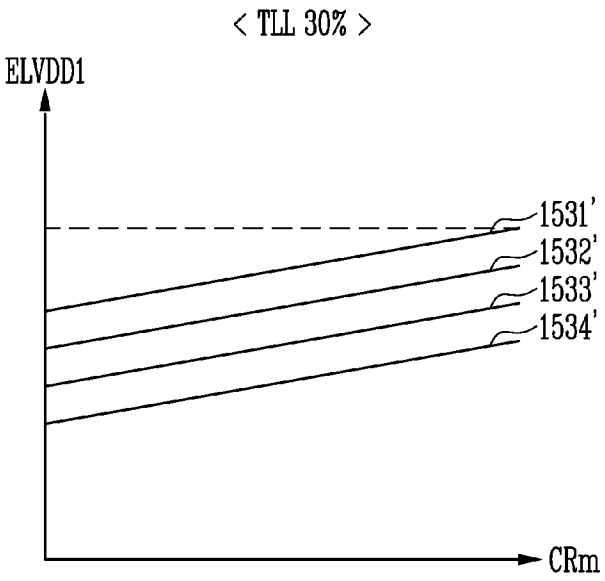
Figure 18A:
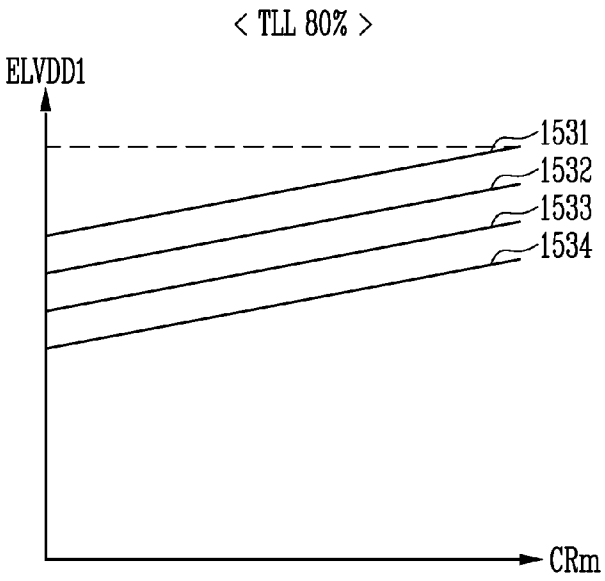

Referring to FIGS. 10 and 18A, the first memory 153 may include a plurality of lookup tables 1531, 1532, 1533, and 1534 with a number of maximum grayscale blocks corresponding to the number of maximum grayscale blocks BLMGNs.

Referring to FIG. 10, the first switch 154 may include a plurality of switches SW1 and SW2. The first switch 154 may select one of the plurality of lookup tables 1531 to 1534 with the number of maximum grayscale blocks according to the received number of maximum grayscale blocks BLMGNs. For example, the first switch 154 may select a lookup table (for example, 1531) with the number of maximum grayscale blocks that provides the high first power source voltage ELVDD1 on average as the number of maximum grayscale blocks BLMGNs of the selected reference block row RBL decreases. Conversely, the first switch 154 may select a lookup table (for example, 1534) with the number of maximum grayscale blocks that provides the low first power source voltage ELVDD1 on average as the number of maximum grayscale blocks BLMGNs of the selected reference block row RBL increases.

Each of the lookup tables 1531 to 1534 with the number of maximum grayscale blocks may be preset to provide an increased first power source voltage ELVDD1 as the grayscale value ratio CRm in the maximum grayscale section SCm increases.

In the present example, the lookup tables 1531, 1532, 1533, and 1534 may correspond to a specific total load value TTL. For example, referring to FIG. 18A, the lookup tables 1531, 1532, 1533, and 1534 may be set based on a reference total load value, for example, 80% of the total load value TLL.

According to an embodiment, in a case where the total load value TTL is different from the reference total load value, the selected lookup table 1531, 1532, 1533, or 1534 may provide the corrected first power source voltage ELVDD1. For example, as shown in FIG. 18B, when the total load value TLL is less than the reference total load value, for example, 30% of the reference total load value, the selected lookup table may provide the first power source voltage ELVDD1 as being corrected to be lower than the reference total load value. For example, when the total load value TLL is greater than the reference total load value, for example, 90% of the reference total load value, the selected lookup table may provide the first power source voltage ELVDD1 as being corrected to be higher than the reference total load value.

According to the above-described embodiment, an increase in the IR drop according to an increase in the total load value TLL can be compensated.

Hereinafter, other example embodiments will be described. In the following embodiments, the same configurations as those of the embodiments described above may be omitted or simplified, and only the differences will be mainly described.

Figure 19:
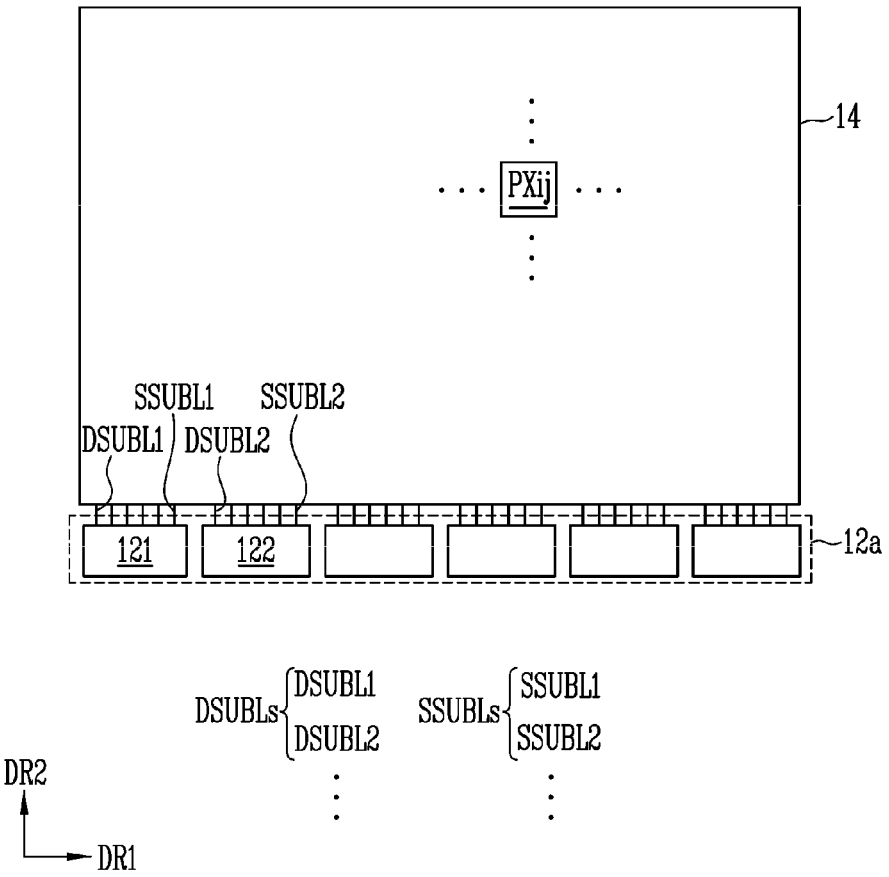
FIG. 19 illustrates an arrangement of a pixel unit and a data driver according to another embodiment of the present disclosure.
Figure 20:
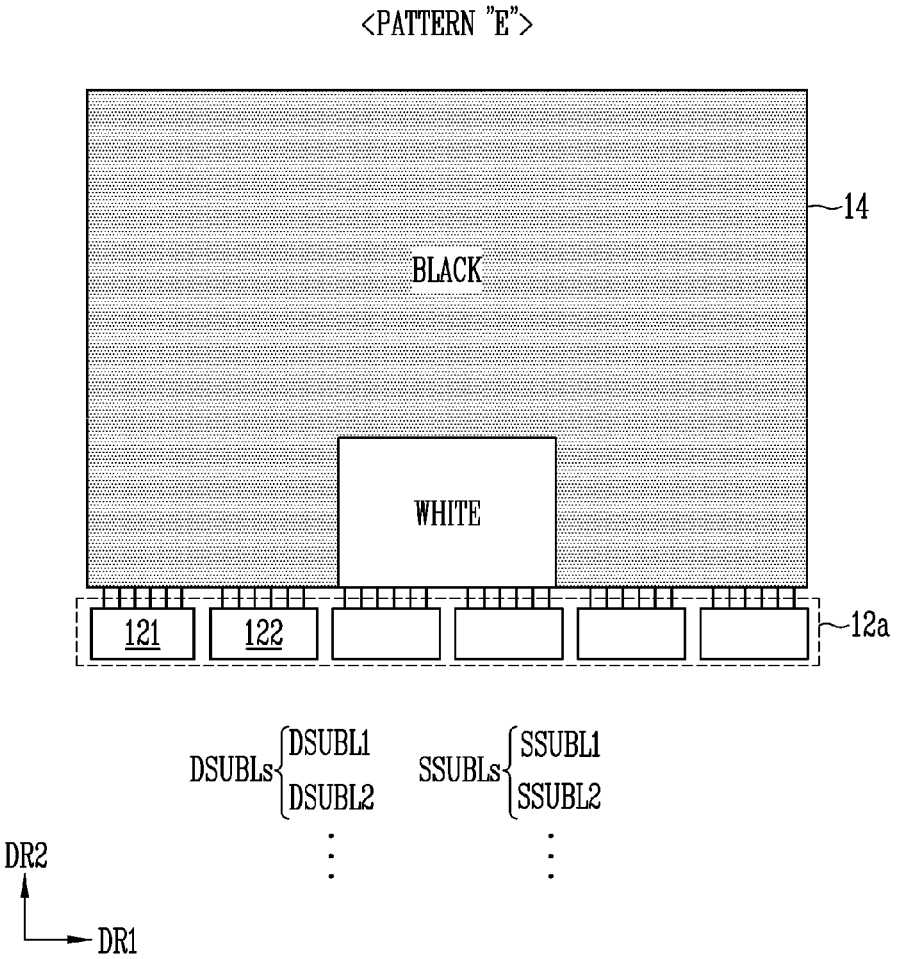
FIG. 20, FIG. 21, and FIG. 22 illustrate exemplary patterns of image frames.
Figure 21:
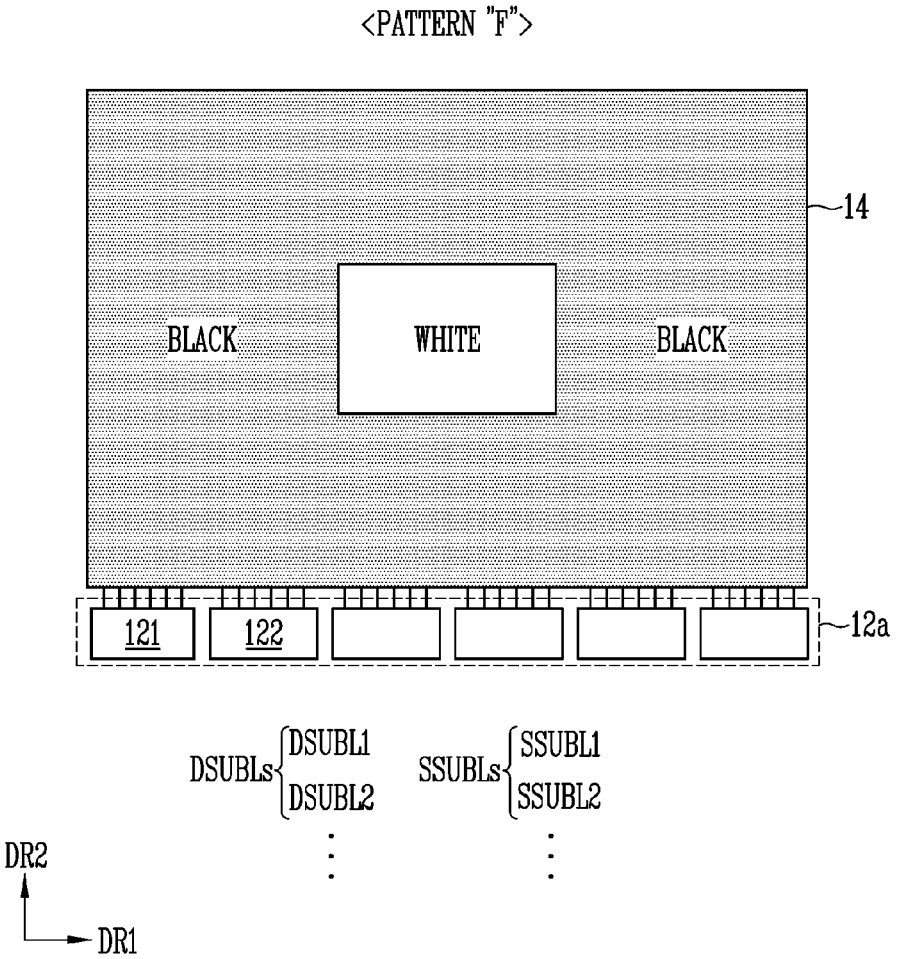
Figure 22:
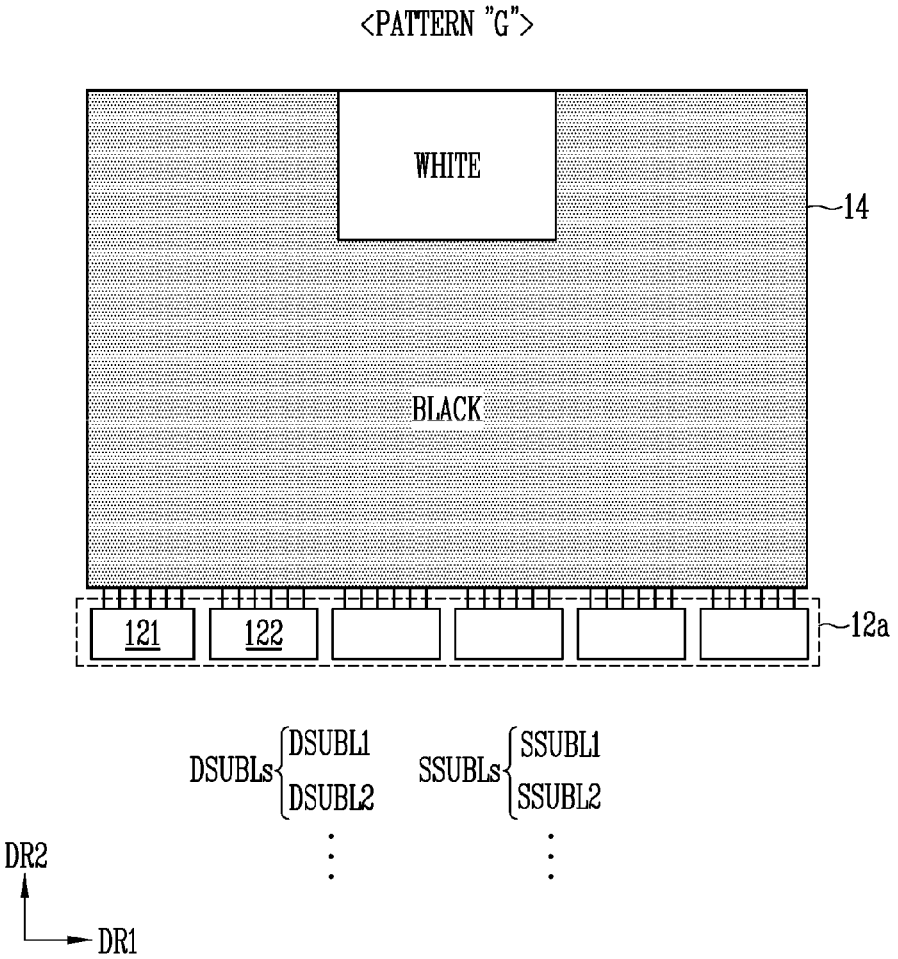
Figure 23:
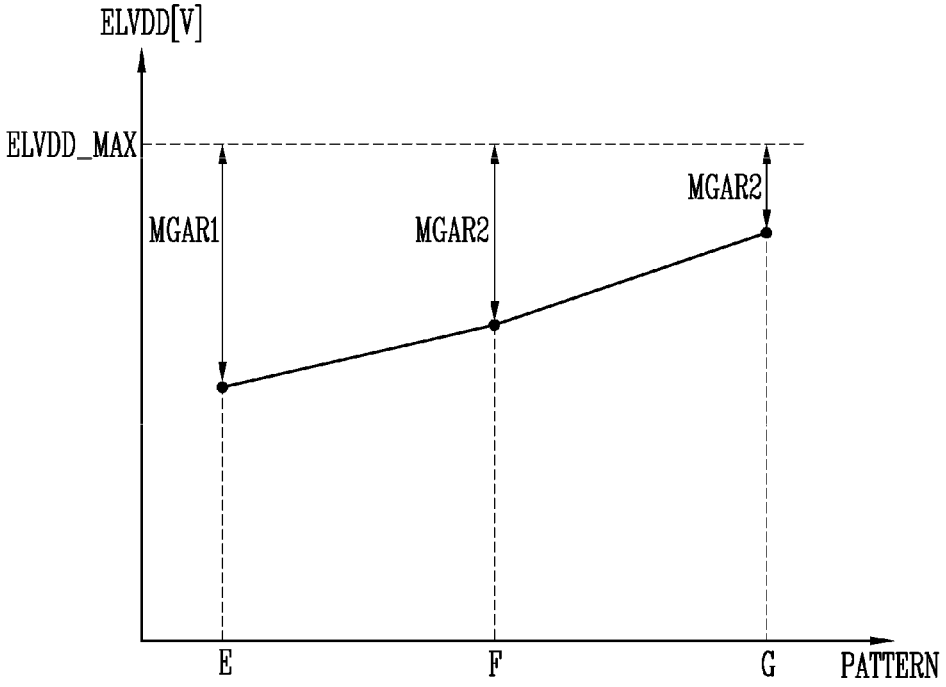
FIG. 23 is a plot showing examples of minimum first power source voltages corresponding to the patterns of FIGS. 20 to 22.

FIG. 19 illustrates an arrangement of a pixel unit and a data driver according to another embodiment of the present disclosure. FIGS. 20 to 22 illustrate exemplary patterns of image frames. FIG. 23 is a plot showing examples of minimum first power source voltages corresponding to the patterns of FIGS. 20 to 22.

Compared with the embodiment described with reference to FIG. 4, the data driver 12 of the embodiment shown in FIG. 19 includes the first data driver 12*a* without including the second data driver 12*b*.

Referring to FIG. 20, an image frame having pattern "E" may be displayed on the pixel unit 14. In pattern "E", a black grayscale region, a white grayscale region, and another black grayscale regions are alternately repeated in the first direction DR1. The white grayscale region is off-center in the pixel unit 14, relatively close to the first power source sub-lines DSUBLs in the second direction DR2.

Referring to FIG. 21, an image frame having pattern "F" may be displayed on the pixel unit 14. In pattern "F", a black grayscale region, a white grayscale region, and another black grayscale region are alternately repeated in the first direction DR1, and the white grayscale region is spaced apart from the first power source sub-lines DSUBLs in the second direction DR2. For example, the white grayscale region may be near a center region of the pixel unit 14. The number of pixels displaying the white grayscale in pattern "F" may be the same as the number of pixels displaying the white grayscale in the "E" pattern.

Referring to FIG. 22, an image frame having pattern "G" may be displayed on the pixel unit 14. In pattern "G", a black grayscale region, a white grayscale region, and another black grayscale region are alternately repeated in the first direction DR1. The white grayscale region is relatively far from the first power source sub-lines DSUBLs in the second direction DR2. The number of pixels displaying the white grayscale in pattern "G" may be the same as the number of pixels displaying the white grayscale in patterns "E" and "F".

Referring to FIG. 23, the minimum required first power source voltage ELVDD is reduced in the order of patterns "G", "F", and "E". This is because the amount of IR drop decreases since the white grayscale region is close to the first power source sub-lines DSUBLs in the order of patterns "G", "F", and "E".

Therefore, allowable margin values MGAR3, MGAR2, and MGAR1 of the first power source voltage ELVDD may be increased in the order of patterns "G", "F", and "E" based on the maximum value ELVDD_MAX of the first power source voltage ELVDD. That is, the larger the margin value, a lowered first power source voltage ELVDD may be supplied.

Accordingly, if a larger margin value can be calculated as the white grayscale region of the image frame is closer to the first power source sub-lines DSUBLs, power consumption of the display device 10 may be reduced.

Figure 24A:
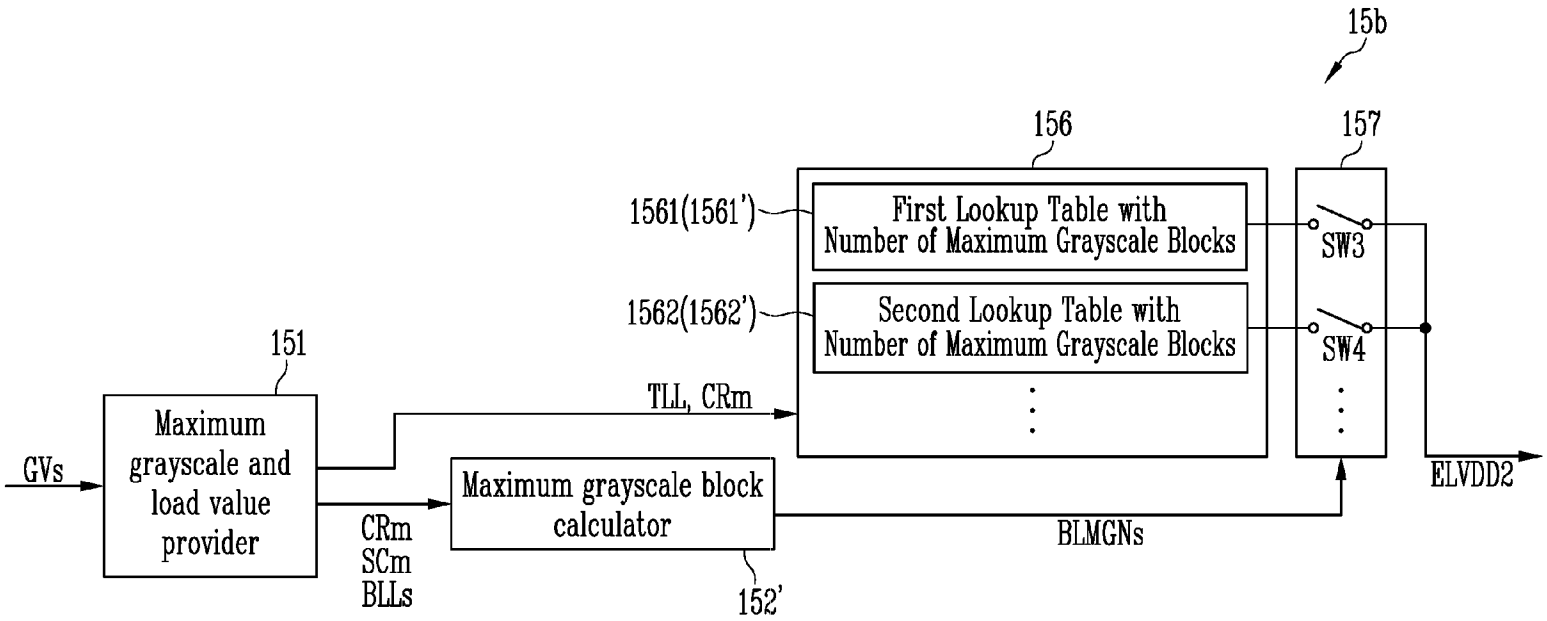
FIG. 24A is a block diagram of a first power source voltage adjuster according to another embodiment of the present disclosure.
Figure 24B:
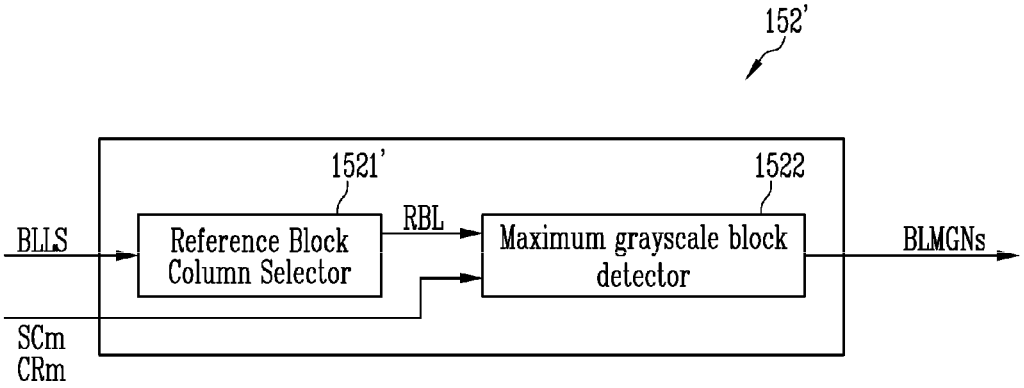
FIG. 24B is a block diagram of a provider of number of maximum grayscale blocks according to another embodiment of the present disclosure.
Figure 25:
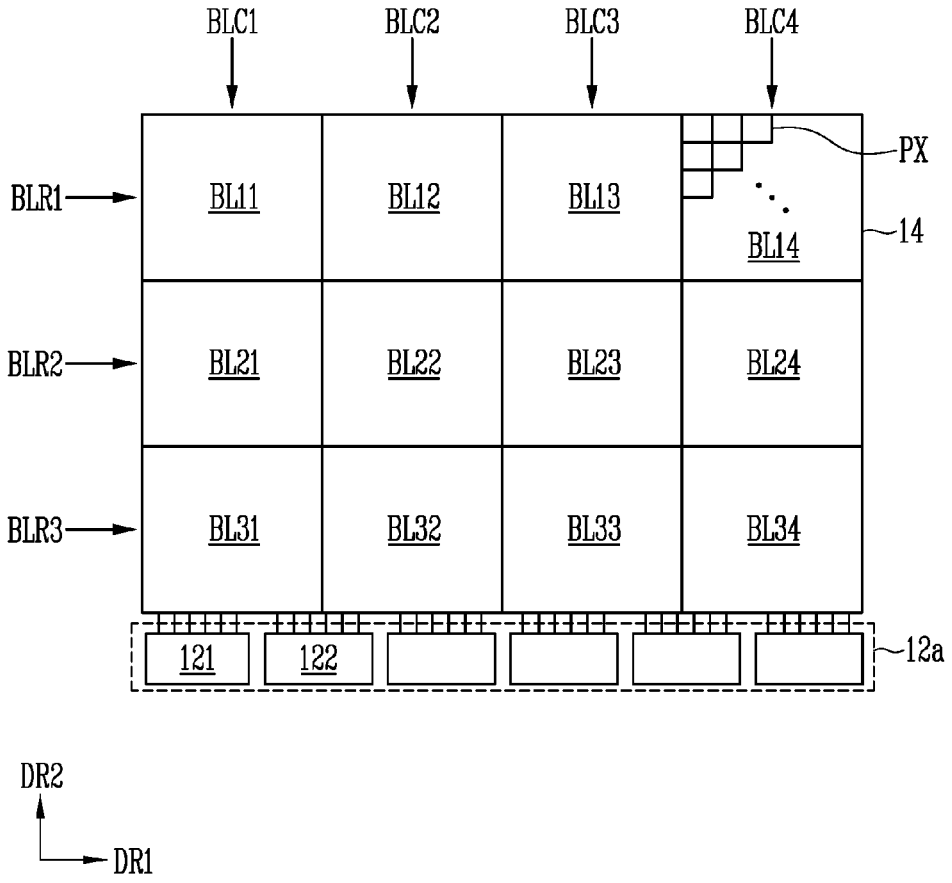
FIG. 25 is a diagram of a reference block column selector according to another embodiment of the present disclosure.

FIG. 24A is a block diagram of a first power source voltage adjuster according to another embodiment of the present disclosure. FIG. 24B is a block diagram of a maximum grayscale block calculator according to another embodiment of the present disclosure. FIG. 25 is a diagram of a reference block column selector according to another embodiment of the present disclosure. FIGS. 26 to 29B illustrate examples of lookup tables with a number of maximum grayscale blocks according to another embodiment of the present disclosure.

While the maximum grayscale block calculator 152 of the embodiment shown in FIG. 10 may include the reference block row selector 1521, a maximum grayscale block calculator 152' of the embodiment shown in FIG. 24A and 24B may include a reference block column selector 1521'. The description of the maximum grayscale and load value provider 151 will be omitted to avoid duplication.

Specifically, referring to FIGS. 24A, 24B, and 25, a first power source voltage adjuster 15*b* may determine the first power source voltage ELVDD based on the number of blocks BLMGNs corresponding to the maximum grayscale section SCm in a specific block column among a plurality of block columns extending in the second direction DR2 and arranged in the first direction DR1 and the load value of the image frame.

Referring to FIG. 25, the pixel unit 14 may be divided into 12 blocks arranged in a 3×4 matrix. In this case, the pixel unit 14 may include first to fourth block columns BLC1, BLC2, BLC3, and BLC4. However, the number of the plurality of blocks and the number of rows and columns of the blocks in the image frame are not limited thereto, and may be variously changed according to the size of the image frame. Meanwhile, the load value of the image frame may be the total load value TLL of the image frame.

For example, in a case where the total load value TLL of the image frame is the same, as the number of blocks BLMGNs corresponding to the maximum grayscale section SCm in the specific block column among the first to fourth block columns BLC1, BLC2, BLC3, and BLC4 increases, the first power source voltage adjuster 15*b* may determine that the first power source voltage ELVDD is to be increased. Conversely, as the number of blocks BLMGNs corresponding to the maximum grayscale section SCm in the specific block column among the first to fourth block columns BLC1, BLC2, BLC3, and BLC4 decreases, the first power source voltage adjuster 15*a* may determine that the first power source voltage ELVDD is to be decreased.

Referring to FIGS. 11A, 24A, 24B and 25, the maximum grayscale block calculator 152' may receive the maximum grayscale section SCm, the grayscale value ratio CRm corresponding to the maximum grayscale section SCm, and the load values BLLs for each block from the maximum grayscale and load value provider 151 and calculate the number of maximum grayscale blocks BLMGNs. The maximum grayscale block calculator 152' may provide the calculated number of maximum grayscale blocks BLMGNs to a second switch 157.

The maximum grayscale block calculator 152' may include the reference block column selector 1521' and the maximum grayscale block detector 1522.

The reference block column selector 1521' may select one of the first to fourth block columns BLC1, BLC2, BLC3, and BLC4 based on the load values BLLs for each block.

For example, a block column having the largest total sum of load values BLLs of a plurality of blocks in the block column among the first to fourth block columns BLC1 to BLC4 may be selected as a reference block column RBL.

Figure 26:
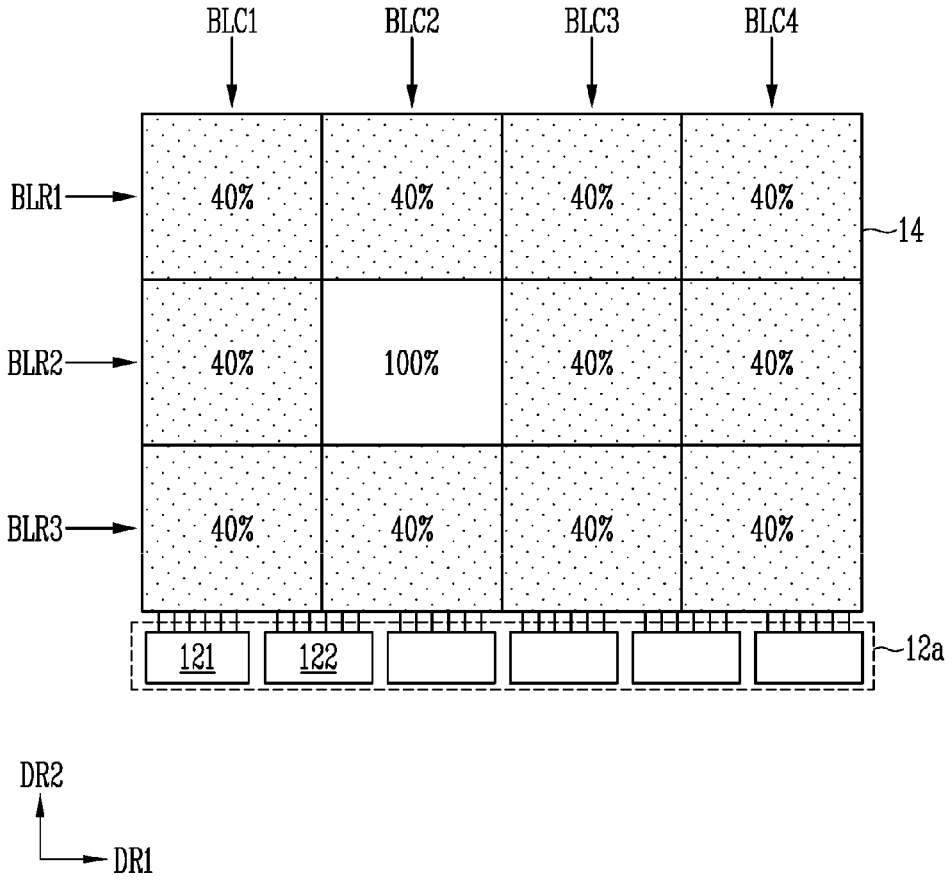
FIG. 26, FIG. 27, FIG. 28, FIG. 29A, and FIG. 29B illustrate example of lookup tables with a number of maximum grayscale blocks according to another embodiment of the present disclosure.

Referring to FIG. 26, the first, third and fourth block columns BLC1, BLC3, and BLC4 have a total sum of load values BLLs of 120%, and a second block column BLC2 has a total sum of load values BLLs of 180%. Therefore, the reference block column selector 1521' may select the second block column BLC2 as the reference block column. Similarly, in the embodiments of FIGS. 27 and 28, the reference block column selector 1521' may select the second block column BLC2 as the reference block column.

The maximum grayscale block detector 1522 may receive the reference block column RBL from the reference block column selector 1521', and detect the number of maximum grayscale blocks BLMGNs defined as the number of blocks having the same maximum grayscale section as the maximum grayscale section of the reference block column among the blocks in the reference block column RBL using the maximum grayscale section SCm and the grayscale value ratio CRm corresponding to the maximum grayscale section SCm that are received from the maximum grayscale section detector 1512 of the maximum grayscale and load value provider 151. Here, the maximum grayscale section SCm of the reference block column RBL may refer to a grayscale section including the largest grayscale value among the grayscale sections having a grayscale value ratio that is greater than the minimum ratio MINR.

Figure 27:
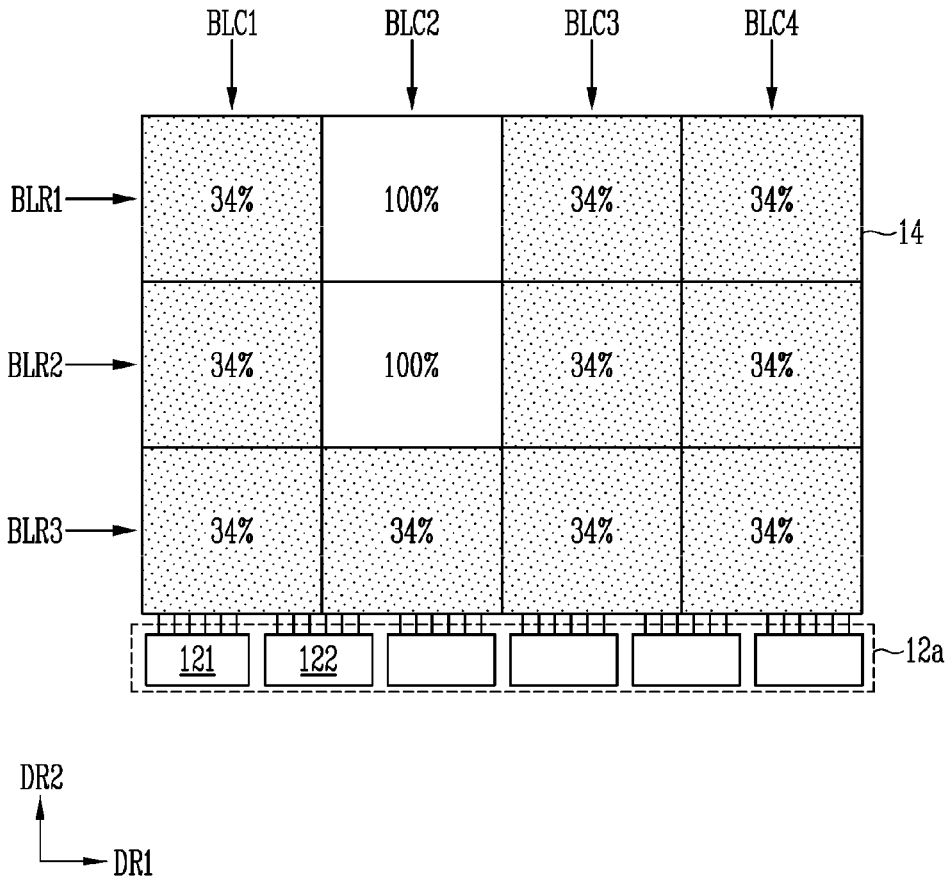
Figure 28:
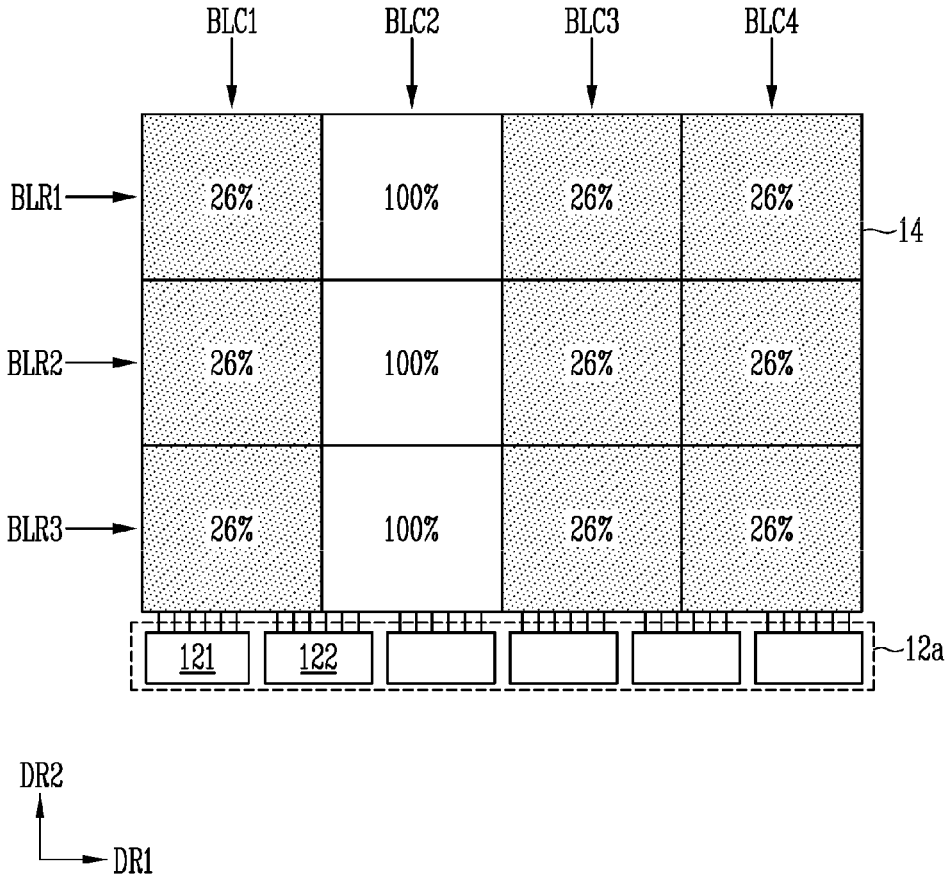

In the embodiments of FIGS. 26 to 28, the total load value TLL of the image frame is the same, for example, 45%, and the grayscale value ratio CRm in the maximum grayscale section SCm of the second block column BLC2 is the same at 100%, but the number of maximum grayscale blocks BLMGNs is different from each other. In this case, an amount of IR drop of each first power source voltage ELVDD1 may be the smallest in FIG. 26 and the largest in FIG. 28. Compared to the embodiments of FIGS. 26 and 27, in the embodiment of FIG. 28, since most of the load may be concentrated on a specific driver, the amount of IR drop may be increased. Accordingly, in a case where the same first power source voltage ELVDD1 is provided in the embodiments of FIGS. 26 to 28, an issue associated with luminance reduction may occur in the embodiment of FIG. 28 compared to the embodiment of FIG. 26.

Figure 29B:
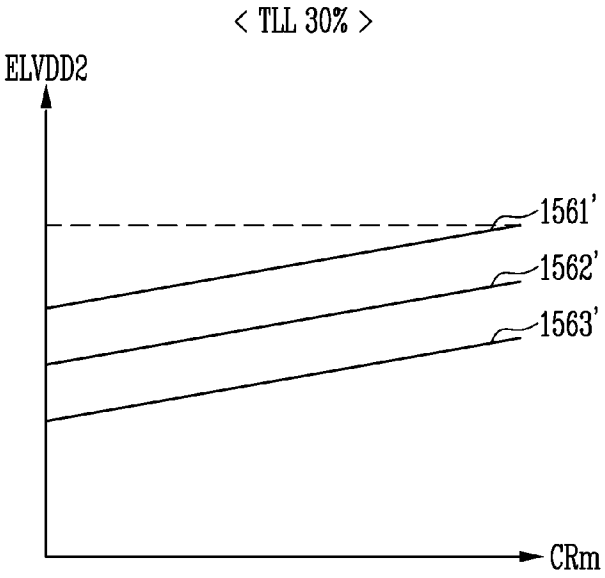
Figure 29A:
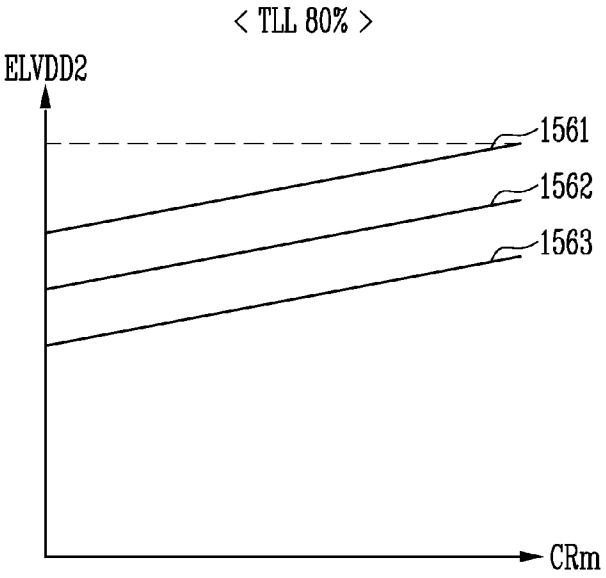

Referring to FIGS. 24A, 24B, and 29A, the first power source voltage adjuster 15*a* includes a second memory 156 that includes a plurality of lookup tables, for example, lookup tables 1561, 1562, and 1563 with a number of maximum grayscale blocks corresponding to the number of maximum grayscale blocks BLMGNs.

Meanwhile, a first power source voltage ELVDD2 described in the embodiments of FIGS. 24A, 29A and 29B may be provided on average higher than the first power source voltage ELVDD1 described with reference to the embodiments of FIGS. 10, 18A and 18B.

Referring to FIG. 24A, the second switch 157 may include a plurality of switches SW3 and SW4. The second switch 157 may select one of the plurality of lookup tables 1561 to 1563 with the number of maximum grayscale blocks according to the received number of maximum grayscale blocks BLMGNs. For example, the second switch 157 may select a lookup table (for example, 1561) with the number of maximum grayscale blocks that provides the high first power source voltage ELVDD2 on average as the number of maximum grayscale blocks BLMGNs in the selected reference block column RBL increases. Conversely, the second switch 157 may select a lookup table (for example, 1563) with the number of maximum grayscale blocks that provides the low first power source voltage ELVDD1 on average as the number of maximum grayscale blocks BLMGNs in the selected reference block column RBL decreases.

Each of the lookup tables 1561 to 1563 with the number of maximum grayscale blocks may be preset to provide an increased first power source voltage ELVDD2 as the grayscale value ratio CRm in the maximum grayscale section SCm increases.

In the present example, the lookup tables 1561, 1562, and 1563 may corresponded to a specific total load value TTL. For example, referring to FIG. 29A, the lookup tables 1561, 1562, and 1563 may be set based on the reference total load value, for example, 80% of the total load value TTL.

According to an embodiment, in a case where the total load value TTL is different from the reference total load value, the selected lookup table 1561, 1562, or 1563 may provide the corrected first power source voltage ELVDD2. For example, as shown in FIG. 29B, when the total load value TLL is less than the reference total load value, for example, 30% of the reference total load value, the selected lookup table may provide the first power source voltage ELVDD2 as being corrected to be lower than the reference total load value. For example, when the total load value TLL is greater than the reference total load value, for example, 90% of the reference total load value, the selected lookup table may provide the first power source voltage ELVDD2 as being corrected to be higher than the reference total load value.

According to the above-described embodiment, an increase in the IR drop according to an increase in the total load value TLL can be compensated.

Figure 30:
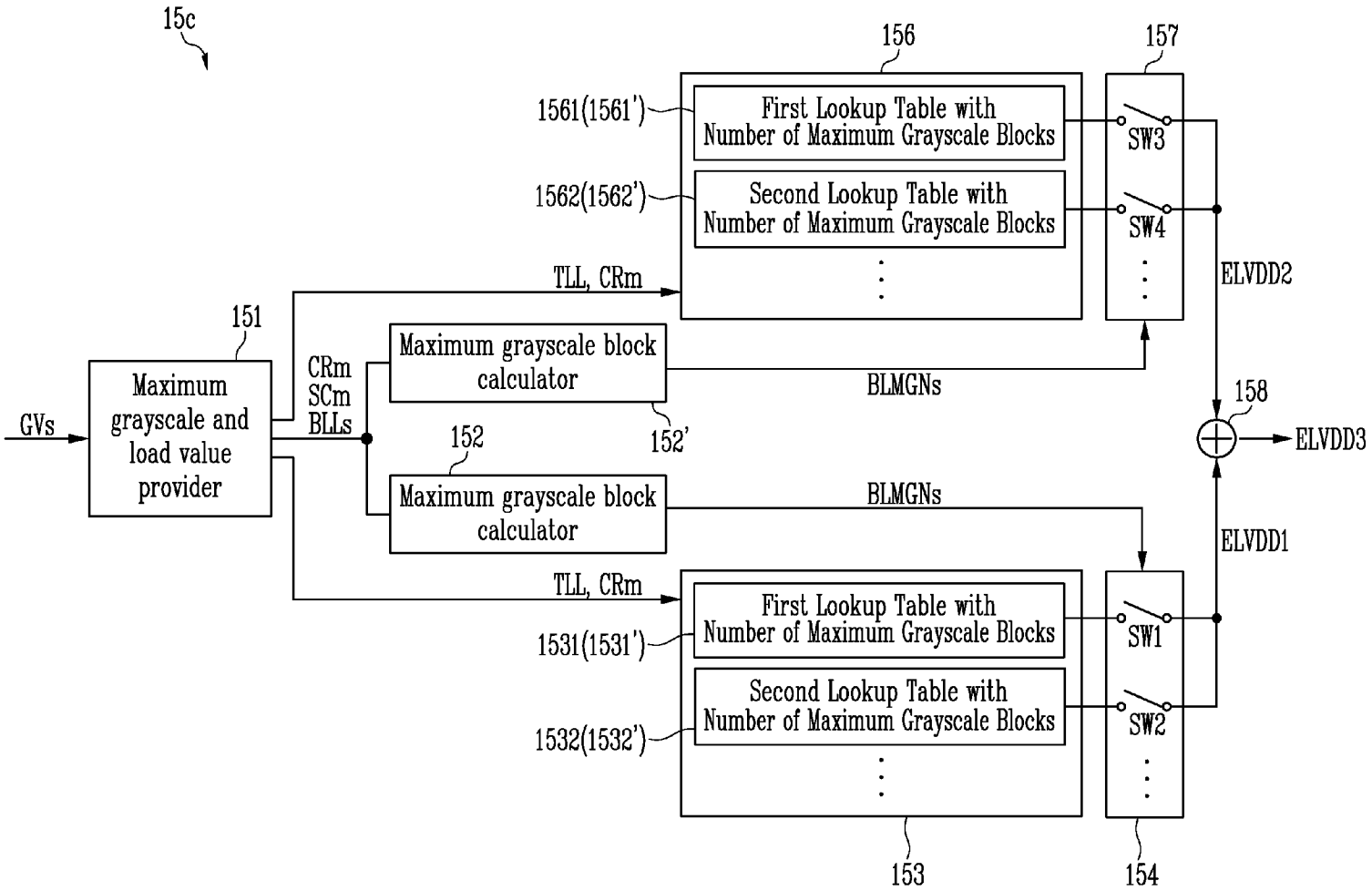
FIG. 30 is a block diagram of a first power source voltage adjuster according to still another embodiment of the present disclosure.

FIG. 30 is a block diagram of a first power source voltage adjuster according to still another embodiment of the present disclosure.

Referring to FIG. 30, a first power source voltage adjuster 15*c* according to still another embodiment of the present disclosure may include the maximum grayscale and load value provider 151, the maximum grayscale block calculators 152 and 152', the first memory 153, the first switch 154, the second memory 156, the second switch 157, and an adder 158. The descriptions of the maximum grayscale and load value provider 151, the maximum grayscale block calculators 152 and 152', the first memory 153, the first switch 154, the second memory 156, and the second switch 157 may be omitted to avoid duplication.

The adder 158 may output a final first power source voltage ELVDD3 based on the first power source voltage ELVDD1 of the first power source voltage adjuster 15*a* based on the number of maximum grayscale blocks BLMGNs in the reference block row RBL and the first power source voltage ELVDD2 of the first power source voltage adjuster 15*b* based on the number of maximum grayscale blocks BLMGNs in the reference block column RBL. For example, the adder 158 may apply the same weights or different weights to the first power source voltage ELVDD1 of the first power source voltage adjuster 15*a* and the first power source voltage ELVDD2 of the first power source voltage adjuster 15*b*. The weights may be 0 in some embodiments.

According to the display device of the present disclosure and the method of driving the same, power consumption of the display device may be reduced by analyzing the maximum grayscale and a load for each block of the image frame and supplying a minimum power source voltage.

The drawings referred to heretofore and the detailed description of the present disclosure described above are merely illustrative of the inventive concepts. It is to be understood that the inventive concept has been disclosed for illustrative purposes only and is not intended to limit the scope of the inventive concept. Therefore, those skilled in the art will appreciate that various modifications and equivalent embodiments are possible without departing from the scope of the present disclosure. Accordingly, the scope of the present inventive concepts should be determined by the technical idea described throughout the present disclosure including the appended claims.

What is claimed is:

1. A display device comprising:

a pixel unit including a plurality of pixels arranged in a first direction and a second direction; and a power source providing a power source voltage to the plurality of pixels;

wherein, when an image pattern is displayed through the pixel unit, the magnitude of the power source voltage is adjusted based on any one of a length of the image pattern in the first direction and the length of the image pattern in the second direction, wherein the power source voltage is adjusted to increase as the length of the image pattern in the first direction decreases and increases as the length of the image pattern in the second direction increases, wherein the plurality of pixels are grouped into a plurality of blocks, wherein the plurality of blocks is divided into a plurality of block rows extending in the first direction and arranged in the second direction, and each of the plurality of pixels is assigned with a grayscale value in a range of grayscale values that is divided into a plurality of grayscale sections, wherein the image pattern is varied according to a grayscale value of the pixels included in each of the plurality of blocks, wherein the power source provides the power source voltage to the pixels included in each of the plurality of blocks, wherein the magnitude of the power source voltage is adjusted based on a number of blocks in a reference block row having a grayscale section that is same as a maximum grayscale section of the reference block row, wherein the maximum grayscale section corresponds to a grayscale section that includes a largest grayscale value among the plurality of grayscale sections having a grayscale value ratio greater than a minimum ratio, wherein the reference block row is selected among the plurality of block rows based on load values for each block included in each of the plurality of block rows, and wherein the number of blocks having the maximum grayscale section in the reference block row is detected based on the maximum grayscale section and a grayscale value ratio of the maximum grayscale section.

2. The display device of claim 1, further comprising:

a first power source voltage adjuster selecting the reference block row among the plurality of block rows, and determining the magnitude of the power source voltage, wherein the first power source voltage adjuster determines that the magnitude of the power source voltage is increased as the number of blocks having the maximum grayscale section among the blocks in the reference block row decreases, and determines that the magnitude of the power source voltage is decreased as the number of blocks having the maximum grayscale section among the blocks in the reference block row increases.

3. The display device of claim 1, wherein the first power source voltage adjuster comprises:

a maximum grayscale section and load value provider providing the maximum grayscale section and a load value for each block among the plurality of blocks using grayscale values of an image frame, a maximum grayscale block calculator selecting the reference block row among the plurality of block rows and detecting the number of blocks having the maximum grayscale section in the reference block row, a first memory including first lookup tables; and a first switch selecting one of the first lookup tables in response to the number of blocks corresponding to the maximum grayscale section provided from the maximum grayscale block calculator.

4. The display device of claim 3, wherein the maximum grayscale section and load value provider comprises:

a grayscale value counter receiving the grayscale values for each of the plurality of blocks and calculating grayscale value ratios of the plurality of grayscale sections;

a maximum grayscale section detector receiving the grayscale value ratios and detecting the maximum grayscale section for each of the blocks in the plurality of block rows and the grayscale value ratio of the maximum grayscale section; and a load value calculator receiving the grayscale values for each of the plurality of blocks and calculating the load value for each block and a total load value of the image frame.

5. The display device of claim 3, wherein the maximum grayscale block calculator comprises:

a reference block row selector selecting the reference block row among the plurality of block rows based on the load values for each block; and a maximum grayscale block detector detecting the number of blocks having the maximum grayscale section in the reference block row based on the maximum grayscale section received from the maximum grayscale section detector and the grayscale value ratio of the maximum grayscale section.

6. The display device of claim 5, wherein the reference block row selector selects the reference block row based on a largest total sum of the load values for each block among the plurality of block rows.

7. The display device of claim 6, wherein the first memory comprises the first lookup tables corresponding to the number of blocks having the maximum grayscale section.

8. The display device of claim 7, wherein the first power source voltage adjuster selects one of the first lookup tables based on the number of blocks having the maximum grayscale section in the reference block row through the first switch.

9. The display device of claim 8, wherein a selected first lookup table among the first lookup tables provides the power source voltage increased as the grayscale value ratio of the maximum grayscale section increases.

10. A display device comprising:

a pixel unit including a plurality of pixels arranged in a first direction and a second direction; and a power source providing a power source voltage to the plurality of pixels;

wherein, when an image pattern is displayed through the pixel unit, the magnitude of the power source voltage is adjusted based on any one of a length of the image pattern in the first direction and the length of the image pattern in the second direction, wherein the plurality of pixels are grouped into a plurality of blocks, wherein a plurality of block columns extending in the second direction and arranged in the first direction, and each of the plurality of pixels is assigned with a grayscale value in a range of grayscale values that is divided into a plurality of grayscale sections, wherein the image pattern is varied according to a grayscale value of the pixels included in each of the plurality of blocks, the power source provides the power source voltage to the pixels included in each of the plurality of blocks, wherein the magnitude of the power source voltage is changed based on a number of blocks in a reference block column having a grayscale section that is same as a maximum grayscale section of the reference block column, wherein the maximum grayscale section corresponds to a grayscale section that includes a largest grayscale value among the plurality of grayscale sections having a grayscale value ratio greater than a minimum ratio, wherein the reference block column is selected among the plurality of block columns based on load values for each block included in each of the plurality of block columns, and wherein the number of blocks having the maximum grayscale section in the reference block columns is detected based on the maximum grayscale section and a grayscale value ratio of the maximum grayscale section.

11. The display device of claim 10, further comprising:

a second power source voltage adjuster selecting the reference block column among the plurality of block columns, and determining the magnitude of the power source voltage, wherein the second power source voltage adjuster comprises:

a maximum grayscale section and load value provider providing the maximum grayscale section and a load value for each block among the plurality of blocks using grayscale values of an image frame, a maximum grayscale block calculator selecting the reference block column among the plurality of block columns and detecting the number of blocks having the maximum grayscale section in the reference block column, a second memory including second lookup tables and a second switch selecting one of the second lookup tables in response to the number of blocks corresponding to the maximum grayscale section provided from the maximum grayscale block calculator.

12. The display device of claim 11, wherein the second power source voltage adjuster determines that the magnitude of the power source voltage is increased as the number of blocks having the maximum grayscale section among the blocks in the reference block column increases, and determines that the magnitude of the power source voltage is decreased as the number of blocks having the maximum grayscale section among the blocks in the reference block column decreases.

13. The display device of claim 11, wherein the maximum grayscale section and load value provider comprises:

a grayscale value counter receiving the grayscale values for each of the plurality of blocks and calculating grayscale value ratios of the plurality of grayscale sections;

a maximum grayscale section detector receiving the grayscale value ratios and detecting the maximum grayscale section for each of the blocks in the plurality of block columns and the grayscale value ratio of the maximum grayscale section; and a load value calculator receiving the grayscale values for each of the plurality of blocks and calculating the load value for each block and a total load value of the image frame.

14. The display device of claim 13, wherein the maximum grayscale block calculator comprises:

a reference block column selector selecting the reference block column among the plurality of block columns based on the load values for each block; and a maximum grayscale block detector detecting the number of blocks having the maximum grayscale section in the reference block column based on the maximum grayscale section received from the maximum grayscale section detector and the grayscale value ratio of the maximum grayscale section.

15. The display device of claim 14, wherein the reference block column selector selects the reference block column based on a largest total sum of the load values for each block among the plurality of block columns.

16. The display device of claim 15, wherein the second memory comprises the second lookup tables corresponding to the number of blocks having the maximum grayscale section.

17. The display device of claim 16, wherein the second power source voltage adjuster selects one of the second lookup tables based on the number of blocks having the maximum grayscale section in the reference block column through the second switch.

18. The display device of claim 17, wherein a selected second lookup table among the second lookup tables provides the power source voltage increased as the grayscale value ratio of the maximum grayscale section increases.

* * * * *